US011976861B2

(12) United States Patent
Deivasigamani et al.

(10) Patent No.: US 11,976,861 B2
(45) Date of Patent: May 7, 2024

(54) ELECTRIC HEATING AND COOLING SYSTEM

(71) Applicant: Intellihot, Inc., Galesburg, IL (US)

(72) Inventors: Sridhar Deivasigamani, Mundelein, IL (US); Sivaprasad Akasam, Round Rock, TX (US)

(73) Assignee: Intellihot, Inc., Galesburg, IL (US)

( * ) Notice: Subject to any disclaimer, the term of this patent is extended or adjusted under 35 U.S.C. 154(b) by 0 days.

(21) Appl. No.: 18/134,667

(22) Filed: Apr. 14, 2023

(65) Prior Publication Data

US 2023/0272953 A1 Aug. 31, 2023

Related U.S. Application Data

(62) Division of application No. 17/012,346, filed on Sep. 4, 2020, now Pat. No. 11,662,127.

(51) Int. Cl.
*F25B 49/02* (2006.01)
*F25B 13/00* (2006.01)
*F25B 30/02* (2006.01)

(52) U.S. Cl.
CPC ..... *F25B 49/02* (2013.01); *F25B 13/00* (2013.01); *F25B 30/02* (2013.01)

(58) Field of Classification Search
CPC ..... F25B 13/00; F25B 49/02
See application file for complete search history.

(56) References Cited

U.S. PATENT DOCUMENTS

2015/0285539 A1* 10/2015 Kopko ..... F25B 41/39 62/324.1
2020/0116438 A1* 4/2020 Sinha ..... F24D 11/0214
2020/0363110 A1* 11/2020 Suzuki ..... F24F 3/065
2022/0074604 A1* 3/2022 Deivasigamani ..... F24H 7/02
2023/0272953 A1* 8/2023 Deivasigamani ..... F25B 30/02 62/160

* cited by examiner

*Primary Examiner* — Henry T Crenshaw
(74) *Attorney, Agent, or Firm* — Jong Patent Firm; Cheng Ning Jong; Tracy P. Jong

(57) ABSTRACT

A present heating system or heating and cooling system does not include a tank for storing potable hot water in anticipation of a potable hot water demand. Although one or more temperature sensors may be used for providing feedback to heating of the contents of a tank water heater to achieve a setpoint temperature, the effect of stratification can cause layers of fluid having different temperatures in the tank water heater. Therefore, although portions of the contents of a water heater may be disposed at a setpoint temperature that is unfavorable for *Legionella* proliferation, there potentially exists other portions that may be disposed at temperatures suitable for *Legionella* proliferation, especially when the contents have been left unused for an extended period of time.

10 Claims, 17 Drawing Sheets

ELECTRIC HEATING AND COOLING SYSTEM

PRIORITY CLAIM AND RELATED APPLICATIONS

This divisional application claims the benefit of priority from non-provisional application U.S. Ser. No. 17/012,346 filed Sep. 4, 2020. Said application is incorporated by reference in its entirety.

BACKGROUND OF THE INVENTION

1. The Field of the Invention

The present invention relates to an electric space heating, space cooling and water heating system. More specifically, the present invention is directed to an electric space heating, space cooling and water heating system including a heat pump and an energy storage device.

2. Background Art

Various fossil fuel phase-out initiatives have been made in the heating industry and mandates have been increasingly devised and implemented to phase out the direct or indirect use of fossil fuel in heat production for domestic and/or industrial uses.

Attempts have been made to heat domestic water with alternative means, e.g., with the use of heat pumps having operations that are primarily driven using electricity in the form of pump or compressor operations. Supplemental electric heating elements may also be employed to aid fossil fuel-free domestic water heating systems in meeting heating demands. However, the need to meet heating demands have driven designers to return to tanked solutions which bring back the disadvantages associated with such solutions, one of the disadvantages being the exposure of stagnant domestic water disposed at temperature ranges suitable for *Legionella* proliferation when hot water demands are small, over extended periods. Two examples of tanked solutions are included herein where domestic hot water is supplied directly from a tank in each of these examples:

U.S. Pat. Pub. No. 20190128565 of Pugh et al. (hereinafter Pugh) discloses a heat pump water heater having a tank, a heat source and a heat pump system. The heat pump system has a refrigerant path, at least a portion of which is in thermal communication with the water tank volume such that heat transfers from a refrigerant to the water tank volume. A fan causes air to flow through a housing, and another portion of the refrigerant path includes an evaporator in the housing. The fan is within the housing and may further be within a second housing. The first housing may include a baffle to direct air flow. The fan may be a variable speed fan in communication with a controller, so that the controller controls the fan speed depending on a temperature of the refrigerant.

U.S. Pat. Pub. No. 20100209084 of Nelson et al. (hereinafter Nelson) discloses a heat pump water heater and systems and methods for its control. The systems are configured to heat water within a water storage tank of a heat pump water heater wherein a controller within the system is operatively connected to a plurality of heat sources including at least one electric heating element and a heat pump and sensors in order to selectively energize one of the plurality of heat sources. The controller is configured to process data representative of the temperature of water within the tank near the top of the water storage tank, and rate of water flowing out of the water storage tank, in order to automatically selectively energize the heat sources. The selection of heat sources by the controller is determined by a mode of operation selected by the user and the data processed by the controller in view of the selected mode of operation.

Each of Pugh and Nelson discloses the use of a large thermal storage tank that accommodates demands of hot water. As each of Pugh and Nelson's tanks holds a significant amount of water to anticipate demands, there is no guaranty that all portions of the heated water in the tank will exit the tank and be replaced with fresh cold or unheated water. If insufficiently used and the water held in the tank is not consumed or replaced over a long period of time, *Legionella* can proliferate and the next user/s can be exposed to a heightened level of *Legionella* risk.

There exists a need for a heating system or a heating and cooling system that is not reliant on fossil fuel-free and one which is not exposed to the same *Legionella* risks plaguing tanked domestic water heating systems.

SUMMARY OF THE INVENTION

In accordance with the present invention, there is provided a heating system including:

(a) a first heat exchanger;

(b) a heat pump including a first fluid moving device operable to circulate a first heat transfer fluid in a first fluid conductor, an indoor/outdoor heat exchanger, a blower operable to supply a stream of fluid over the indoor/outdoor heat exchanger, wherein the indoor/outdoor heat exchanger and the first fluid moving device are fluidly connected to the first fluid conductor and the outdoor heat exchanger being disposed to transfer heat between the first heat transfer fluid and the indoor/outdoor heat exchanger whereby heat is transferred between the first heat transfer fluid and the stream of fluid over the indoor/outdoor heat exchanger;

(c) a tank including a bath;

(d) a second fluid moving device operable to circulate a second heat transfer fluid in a second fluid conductor, wherein the second fluid moving device is fluidly connected to the second fluid conductor and a portion of the second fluid conductor is disposed through the bath of the tank and the second fluid conductor is not fluidly connected to the tank, wherein the first heat exchanger being disposed to transfer heat between the first heat transfer fluid and the second heat transfer fluid;

(e) a mixing valve including two input ports and a discharge port, one of the two input ports fluidly connected to a first end of the portion of the second fluid conductor via a bypass fluid conductor and the other one of the two input ports fluidly connected to a second end of the portion of the second fluid conductor and the discharge port connected to an outlet of the second fluid conductor; and (f) a controller operable to control the first fluid moving device to circulate the first heat transfer fluid in the first fluid conductor, the blower and the second fluid moving device to circulate the second heat transfer fluid in the second fluid conductor in response to a first hot water demand, the controller being further operable to control the mixing valve to allow mixing of the second heat transfer fluid through the portion of the second fluid conductor and the bypass conductor in response to a second hot water demand and the controller being further operable to control the first fluid moving device to circulate the first heat transfer fluid in the first fluid conductor, the blower and the second fluid moving device to circulate the second heat transfer fluid in the second fluid conductor in response to a thermal charging demand of the bath of the tank.

In one embodiment, the first fluid moving device is a compressor, wherein the heat pump further includes an expansion valve fluidly connected to the first fluid conductor. In one embodiment, the portion of the second fluid conductor disposed through the bath of the tank is a heat exchanger being disposed to transfer heat between the bath and the second heat transfer fluid. In one embodiment, the bath includes a material selected from the group consisting of water and a phase change material (PCM). In one embodiment, the heating system further including supplementary heating elements configured to be disposed within the bath of the tank. In one embodiment, the first heat transfer fluid is refrigerant. In one embodiment, the second heat transfer fluid is water. In one embodiment, the heating system further including at least one supplementary heating element configured to be disposed within the bath of the tank. In one embodiment, the heating system further including an electric battery configured for storing electric power and powering at least one of the first fluid moving device, the blower, the second fluid moving device, the mixing valve and the controller.

In accordance with the present invention, there is also provided a heating and cooling system including:

(a) a first subsystem for temperature conditioning an indoor space, the first subsystem including:
  (i) a first heat exchanger;
  (ii) a heat pump including a first fluid moving device operable to circulate a first heat transfer fluid in a first fluid conductor, an outdoor heat exchanger, a first blower operable to supply a stream of fluid over the outdoor heat exchanger, a pair of first hydraulic switches disposed about the outdoor heat exchanger, the pair of first hydraulic switches operable to disconnect the outdoor heat exchanger from the first fluid conductor and a pair of second hydraulic switches disposed about the first heat exchanger, the pair of second hydraulic switches operable to disconnect the first heat exchanger from the first fluid conductor, wherein the outdoor heat exchanger and the first fluid moving device are fluidly connected to the first fluid conductor and the outdoor heat exchanger being disposed to transfer heat between the first heat transfer fluid and the outdoor heat exchanger, whereby heat is transferred between the first heat transfer fluid and the stream of fluid over the outdoor heat exchanger;
  (iii) a second fluid moving device operable to circulate a second heat transfer fluid in a second fluid conductor, an indoor heat exchanger and a second blower operable to supply a stream of fluid over the indoor heat exchanger, wherein the indoor heat exchanger and the second fluid moving device are fluidly connected to the second fluid conductor and the indoor heat exchanger being disposed to transfer heat between the second heat transfer fluid and the indoor heat exchanger, whereby heat is transferred between the second heat transfer fluid and the stream of fluid over the indoor heat exchanger;

(b) a second subsystem for heating liquid, the second subsystem including:
  (i) a second heat exchanger;
  (ii) a tank including a bath;
  (iii) a third fluid moving device operable to circulate a third heat transfer fluid in a third fluid conductor, wherein the second heat exchanger and the third fluid moving device are fluidly connected to the third fluid conductor and a portion of the third fluid conductor is disposed through the bath of the tank and the third fluid conductor is not fluidly connected to the tank;
  (iv) a mixing valve including two input ports and a discharge port, one of the two input ports fluidly connected to a first end of the portion of the third fluid conductor via a bypass fluid conductor and the other one of the two input ports fluidly connected to a second end of the portion of the third fluid conductor and the discharge port connected to an outlet of the third fluid conductor; and
  (v) a fourth fluid conductor including two ends, wherein the second heat exchanger being disposed to transfer heat between the third heat transfer fluid and a fluid within the fourth fluid conductor; and (c) a controller operable to control the first fluid moving device to circulate the first heat transfer fluid in a first direction in the first fluid conductor, the first blower, the second fluid moving device to circulate the second heat transfer fluid in the second fluid conductor and the second blower in response to a space cooling demand, the controller being further operable to control the first fluid moving device to circulate the first heat transfer fluid in a second direction in the first fluid conductor, the first blower, the second fluid moving device and the second blower in response to a space heating demand, the controller being further operable to cause the two ends to be fluidly connected to the pair of second hydraulic switches, the pair of second hydraulic switches disposed in a position to disconnect the first heat exchanger from the first fluid conductor and to connect the fourth fluid conductor to the pair of second switches, the third fluid moving device to circulate the third heat transfer fluid and the first fluid moving device to circulate the first heat transfer fluid in the second direction and the first blower in response to a first hot water demand, the controller being further operable to control the mixing valve to allow mixing of the third heat transfer fluid through the portion of the third fluid conductor and the bypass conductor in response to a second hot water demand, the controller being further operable to cause the two ends to be fluidly connected to the pair of first hydraulic switches, the pair of first hydraulic switches disposed in a position to disconnect the outdoor heat exchanger from the first fluid conductor and to connect the fourth fluid conductor to the pair of first switches, the third fluid moving device to circulate the third heat transfer fluid and the first fluid moving device to circulate the first heat transfer fluid in the second direction in the first fluid conductor, the first blower to turn on, the second fluid moving device to circulate the second heat transfer fluid and the second blower to turn on in response to a space heating demand, the controller being further operable to cause the two ends to be fluidly connected to the pair of first hydraulic switches, the pair of first hydraulic switches disposed in a position to disconnect the outdoor heat exchanger from the first fluid conductor and to connect the fourth fluid conductor to the pair of first hydraulic switches, the third fluid moving device to circulate the third heat transfer fluid, the first fluid moving device to circulate the first heat transfer fluid in the first direction, the first blower to turn on, the second blower to turn on and the second fluid moving device to circulate the second heat transfer fluid in response to a space cooling demand and the controller being further operable to cause the two ends to be fluidly connected to the pair of first hydraulic switches, the pair of first hydraulic switches disposed in a position to disconnect the outdoor heat exchanger from the first fluid conductor and to connect the fourth fluid conductor to the pair of first hydraulic switches, the third fluid moving device to circulate the third heat transfer fluid, the first fluid moving device to circulate the first heat transfer fluid in the first direction and the first blower to turn on in response to a thermal charging demand of the bath of the tank.

In one embodiment, the portion of the third fluid conductor disposed through the bath of the tank is a heat exchanger being disposed to transfer heat between the bath and the third heat transfer fluid. In one embodiment, the first fluid moving device is a compressor, wherein the heat pump further includes an expansion valve fluidly connected to the first fluid conductor. In one embodiment, the heating and cooling system further includes a hydraulic switch configured for reversing a direction of operation of the first fluid moving device. In one embodiment, the bath is water. In another embodiment, the bath is a phase change material (PCM). In one embodiment, the heating and cooling system further includes at least one supplementary heating element configured to be disposed within the bath of the tank. In one embodiment, the first heat transfer fluid is refrigerant. In one embodiment, the second heat transfer fluid is water. In one embodiment, the third heat transfer fluid is water. In one embodiment, the heating and cooling system further includes an electric battery configured for storing electric power and powering at least one of the first fluid moving device, the first blower, the pair of first hydraulic switches, the pair of second hydraulic switches, the second fluid moving device, the second blower, the second fluid moving device, the third fluid moving device, the mixing valve and the controller. In one embodiment, the first heat exchanger includes a tank including a bath, wherein the controller being further operable to control the first fluid moving device to circulate the first heat transfer fluid in a first direction in the first fluid conductor in response to a thermal discharging demand of the bath of the tank.

An object of the present invention is to provide a heating system or a heating and cooling system that does not involve direct generation of hydrocarbons in powering the heating system or the heating and cooling system.

Another object of the present invention is to provide a heating system or a heating and cooling system capable of taking advantage of a favorable pricing of the power, e.g., electric, that drives the system, to store heat energy or to evacuate heat energy to heat or cool at a later time, respectively.

Another object of the present invention is to provide a heating system or a heating and cooling system capable of storing heat energy for use at a later time.

Another object of the present invention is to provide a heating system or a heating and cooling system capable of providing a cold reservoir for use at a later time.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
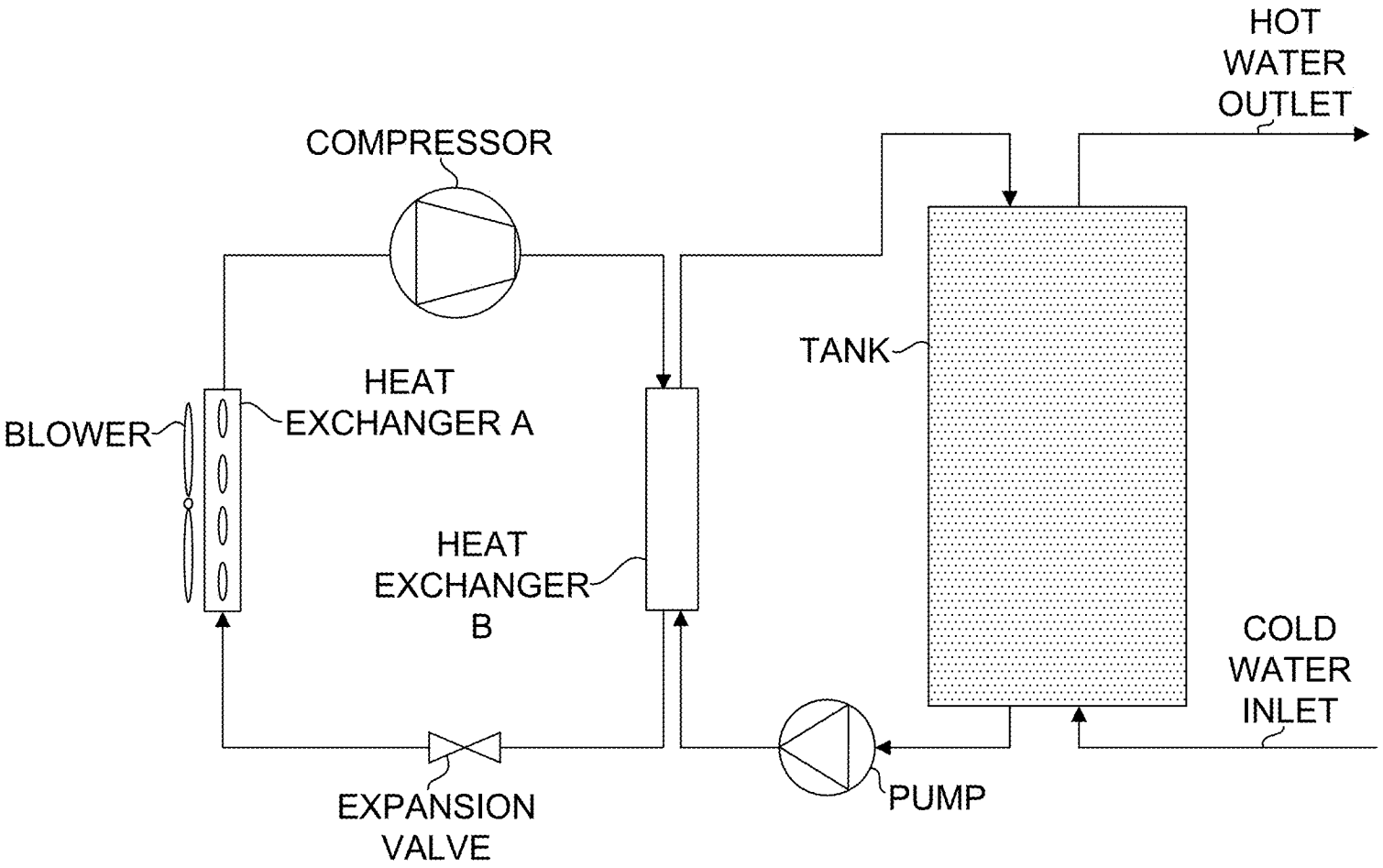
FIG. 1 PRIOR ART
FIG. 1 is diagram depicting a prior art electric domestic water heating system.

2—electric heat pump
4—refrigerant loop
6—water loop
8—space heating or cooling loop
10—compressor
12—expansion valve
14—heat exchanger, e.g., evaporator, condenser
16—blower
18—second heat exchanger, e.g., plate type heat exchanger, condenser
20—thermal storage device
22—heat exchanger, e.g., bi-directional heat exchanger
24—fluid moving device, e.g., pump, e.g., variable speed pump
26—mixing valve, e.g., thermostatic mixing valve
28—cold water inlet
30—hot water outlet
32—supplementary heating element
34—pump
36—blower
37—indoor heat exchanger
38—first heat exchanger, e.g., plate type heat exchanger
40—fluid conductor
42—fluid conductor
44—fluid conductor
46—fluid conductor
48—controller
50—bypass fluid conductor
52—refrigerant flow
54—switch
56—port
58—port
60—port
62—port
64—valve body
66—spool
68—switch
70—port
72—port
74—port
76—port
78—port
80—port
82—valve body
84—spool
86—electric battery
88—space heating or cooling battery
90—indoor/outdoor heat exchanger
92—fluid conductor
94—first end of fluid conductor 92
96—second end of fluid conductor 92

Particular Advantages of the Invention

The present heating system or heating and cooling system does not include a tank for storing potable hot water in anticipation of a potable hot water demand. As such, no stratification of potable water held in a tank can occur. Although one or more temperature sensors may be used for providing feedback to heating of the contents of a tank water heater to achieve a setpoint temperature, the effect of stratification can cause layers of fluid having different temperatures in the tank water heater. Therefore, although portions of the contents of a water heater may be disposed at a setpoint temperature that is unfavorable for *Legionella* proliferation, there potentially exists other portions that may be disposed at temperatures suitable for *Legionella* proliferation, especially when the contents have been left unused for an extended period of time.

The present heating system or heating and cooling system is capable of storing heat energy harnessed from an outdoor ambient of a heat exchanger. In one mode, the heat exchanger disposed outdoor is useful for drawing heat subsequently transferred to be stored in a bath of a tank. In one embodiment, the present heating system or heating and cooling system is capable of storing heat energy harnessed from an indoor ambient of an indoor heat exchanger. In one mode, the air handler disposed outdoor is useful for drawing heat subsequently transferred to be stored in the bath of the tank. In one embodiment, the present heating system or heating and cooling system is capable of storing heat energy obtained from an indoor or outdoor environment. In one embodiment, supplemental or additional heat energy can be supplied by heating elements disposed within the bath of the present tank and powered by grid electricity, solar power means and wind power means. In one embodiment, hot water can be provided even in the event of an electric power failure as a demand of hot water can be met by heating in the incoming cold water supply with the heat energy stored in a tank.

As the present heating system or heating and cooling system includes a domestic water supply that is not fluidly connected to a tank characterized by a low flowrate within the tank, the present system significantly reduces the opportunity for a water flow to deposit scale within the water conductor of the system as the water flow occurs through fluid conductors of a smaller inner diameter instead of the significantly larger volume of a tank.

As the present heating system or heating and cooling system includes an electric battery, the present system reduces the downtime if grid power is down as the system continues to be operational even if grid power is not available. Further, the electric battery serves as a sink for electric grid power when its pricing is favorable or low or when the demand for grid power is low.

Hard water causes unwanted mineral deposits (scaling) on the fluid contact surfaces of the water heater system. Severe scaling can cause severe drop in the water heater efficiency and life span. Scale deposits in the interior surfaces of heat exchanger tubes can reduce the heat exchanger efficiency as the scale deposits reduce heat transfer rate from the exterior to the interior surfaces of the heat exchanger tubes. Therefore, more heat would be required to raise each degree of water temperature. Excessive scale deposits, or any other like issues, that cause reduced heat exchanger efficiency, can lead to overheating of the exterior surfaces of a heat exchanger resulting in a shortened heat exchanger service life. In addition to resulting in damage to the heat exchanger, overheating of the heat exchanger exterior surfaces leads to undue energy loss. As the contents or bath of the present tank is isolated from the domestic water delivered to an end user, the speed of a flow through the domestic water conductor is significantly higher than a flow through a tank, thereby reducing the likelihood that scaling can occur.

Detailed Description of a Preferred Embodiment

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

FIG. 1 is diagram depicting a prior art electric domestic water heating system. The heating system includes a heat pump including a compressor operable to circulate a heat transfer fluid in a first fluid conductor, a heat exchanger, i.e. heat exchanger A, a blower operable to supply a stream of fluid over heat exchanger A. Heat exchanger A and the compressor are fluidly connected to the first fluid conductor and heat exchanger A being disposed to transfer heat between the heat transfer fluid and the heat exchanger A whereby heat is transferred between the heat transfer fluid and the stream of fluid over heat exchanger A. The heating system further includes a tank and a pump operable to circulate a domestic water flow in a second fluid conductor and through the tank. A second heat exchanger, i.e., heat exchanger B, thermally couples the first fluid conductor and the second fluid conductor and it is disposed to transfer heat between the heat transfer fluid and the domestic water flow. It shall be noted that, in one mode, the compressor circulates the heat transfer fluid in the first fluid conductor and the pump to circulate the domestic water flow in the second fluid conductor through the tank in response to a hot water demand. The compressor circulates the heat transfer fluid in the first fluid conductor while the pump circulates the domestic water flow in the second fluid conductor in response to a thermal charging demand of the domestic water in the tank. It shall be noted that the domestic water flow is fluidly connected to the contents of the tank. Therefore, a domestic water flow through the tank is subject to any temperature stratification effects that can occur in the tank. As the domestic water received at the tank flows through a large body of water in the tank, some portions of the contents of the tank can be said to stagnate, a condition suitable for *Legionella* proliferation. A flow through a tank or a large container is characterized by its low speed and there is no guaranty that a flow that enters first into the tank will exit the tank first, leaving behind portions of the contents of the tank having a dwell time suitable for *Legionella* proliferation. Further, it is possible that portions of the domestic water in the tank are disposed at a temperature that falls within a range of temperature suitable for *Legionella* proliferation.

Figure 2:
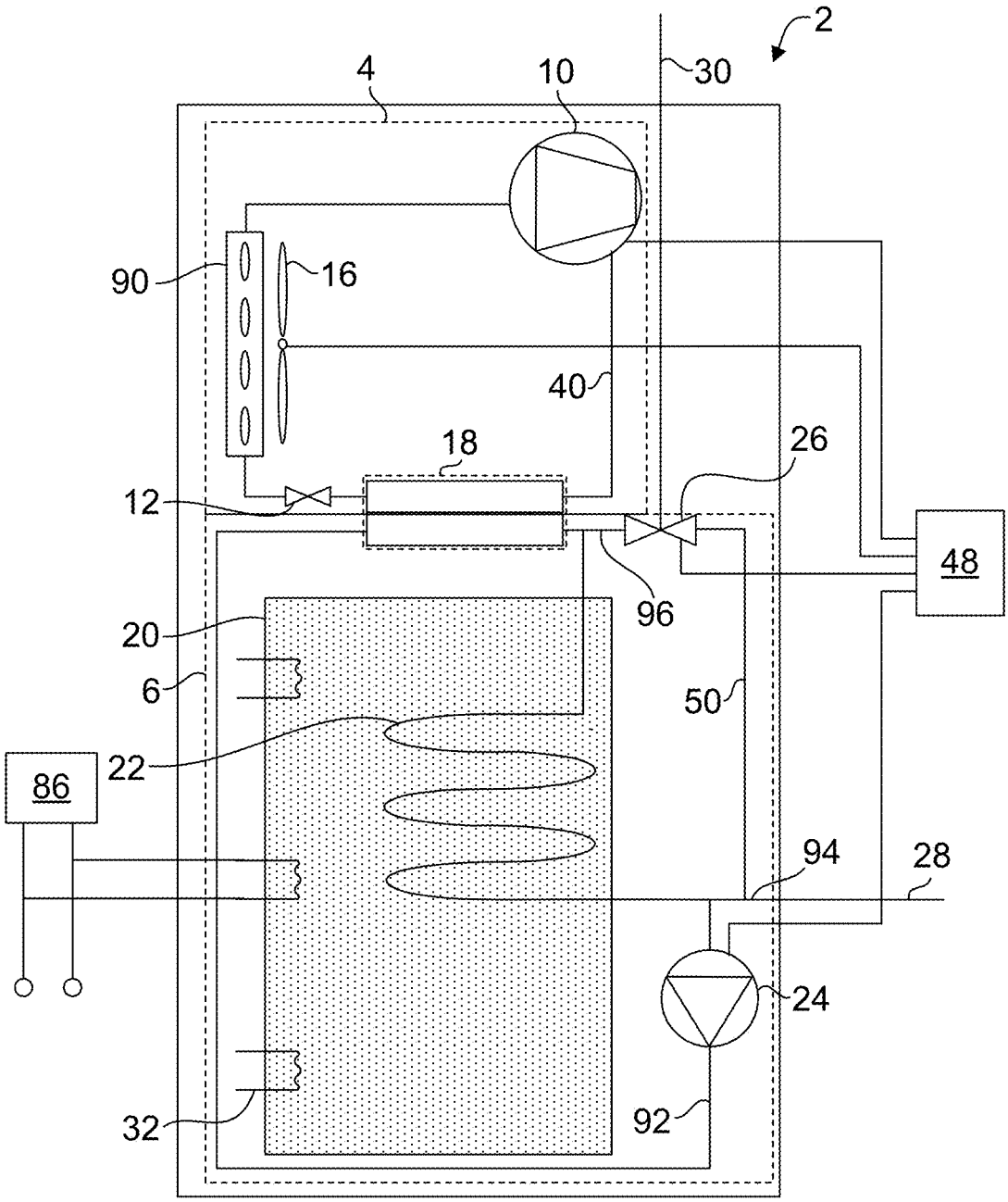
FIG. 2 is diagram depicting a present electric domestic water heating system.

FIG. 2 is diagram depicting a present electric domestic water heating system 2. The heating system 2 includes essentially two subsystems 4, 6. As used herein and throughout the specification and drawings, a subsystem is shown to include components disposed within a box with dashed lines. Subsystems, devices, components and fluid conductors that are inactive or otherwise not involved in the operation of a system are also shown in dashed lines to ease comprehension of the drawings. Subsystem 4 includes a heat pump including a first fluid moving device 10, e.g., compressor, operable to circulate a first heat transfer fluid in a first fluid conductor 40, an indoor/outdoor heat exchanger 90, e.g., evaporator, a first blower 16 operable to supply a stream of fluid over the indoor/outdoor heat exchanger 90, wherein the indoor/outdoor heat exchanger 90 and the first fluid moving device 10 are fluidly connected to the first fluid conductor 40 and the indoor/outdoor heat exchanger 90 being disposed to transfer heat between the first heat transfer fluid 40 and the indoor/outdoor heat exchanger 90 whereby heat is transferred between the first heat transfer fluid and the stream of fluid over the indoor/outdoor heat exchanger 90. In one embodiment, the first heat transfer fluid is a refrigerant, e.g., carbon dioxide. In the embodiment shown, wherein the heat pump further includes an expansion valve 12 fluidly connected to the first fluid conductor. Subsystem 6 includes a tank 20 including a bath, a second fluid moving device 24, e.g., pump, operable to circulate a second heat transfer fluid received through inlet 28 in a second fluid conductor 92. The second heat exchanger 18 and the second fluid moving device 24 are fluidly connected to the second fluid conductor 92 and a portion of the second fluid conductor is disposed through the bath of the tank 20. It shall be noted that the second fluid conductor is not fluidly connected to the tank 20 and therefore the contents or bath of the tank 20 is isolated from the domestic water delivered to an end user, eliminating any ill effects of potential *Legionella* proliferation due to the tank 20. The second heat exchanger 18 is useful for transferring heat between the first heat transfer fluid and the second heat transfer fluid. Subsystem 6 further includes a mixing valve 26 including two input ports and a discharge port, one of the two input ports fluidly connected to a first end 94 of the portion of the second fluid conductor 92 via a bypass fluid conductor 50 and the other one of the two input ports fluidly connected to a second end 96 of the portion of the second fluid conductor 92 and the discharge port connected to an outlet of the second fluid conductor. A controller 48 is further provided and operably connected to the first fluid moving device 10, the mixing valve 26, the second fluid moving device 24 and the blower 16. In the embodiment shown, subsystem 6 further includes an electric battery 86 configured for storing electric power and powering at least one of the first fluid moving device 10, the blower 16, the second fluid moving device 24, the mixing valve 26 and the controller 48. In one embodiment, the operation of the blower 16 mirrors the operation of the first fluid moving device 10. In other words, when the first fluid moving device 10 is turned on, the blower 16 is turned on as well and when the first moving device 10 is turned off, the blower 16 is turned off as well.

The price of electricity supply via an electricity grid can vary over the course of a day according to its demand. For instance, during periods of peak demand for electricity and when its supply is insufficient to cover the demand or when its supply barely meets the demand, electricity is priced at a higher level than when the supply well exceeds the demand. Therefore, it may be advantages to utilize electricity from the grid to charge the electrical battery 86 in order to store electrical energy in the electrical battery 86 in anticipation for later use when grid electricity is more costly. Alternatively and/or additionally, grid electricity can be used to generate heat energy stored in the tank 20 via one or more supplementary heating elements 32 or subsystem 4 even when there is not an immediate need for hot water when the cost of grid electricity is low. The cost of grid electricity may be observed and analyzed using the controller 48 by receiving grid electricity pricing data, e.g., over the internet.

In the embodiment shown, the portion 22 of the second fluid conductor disposed through the bath or immersed in the bath of the tank 20 is a coiled tube heat exchanger being disposed to transfer heat between the bath and the second heat transfer fluid. Note that there is no fluid communication between the bath and the second heat transfer fluid. As such, the second heat transfer fluid is not exposed to any risks associated with *Legionella* due to potential stratification of the bath of the tank 20. The bath can be water or a phase change material (PCM), e.g., paraffins, etc. Water is used both as a second heat transfer fluid when it is used to receive heat from the bath of the tank 20 while being circulated through the bath of the tank 20 as disclosed elsewhere herein or as a resource that is consumed by a user when supplied through outlet 30 as shown in FIG. 3.

Figure 3:
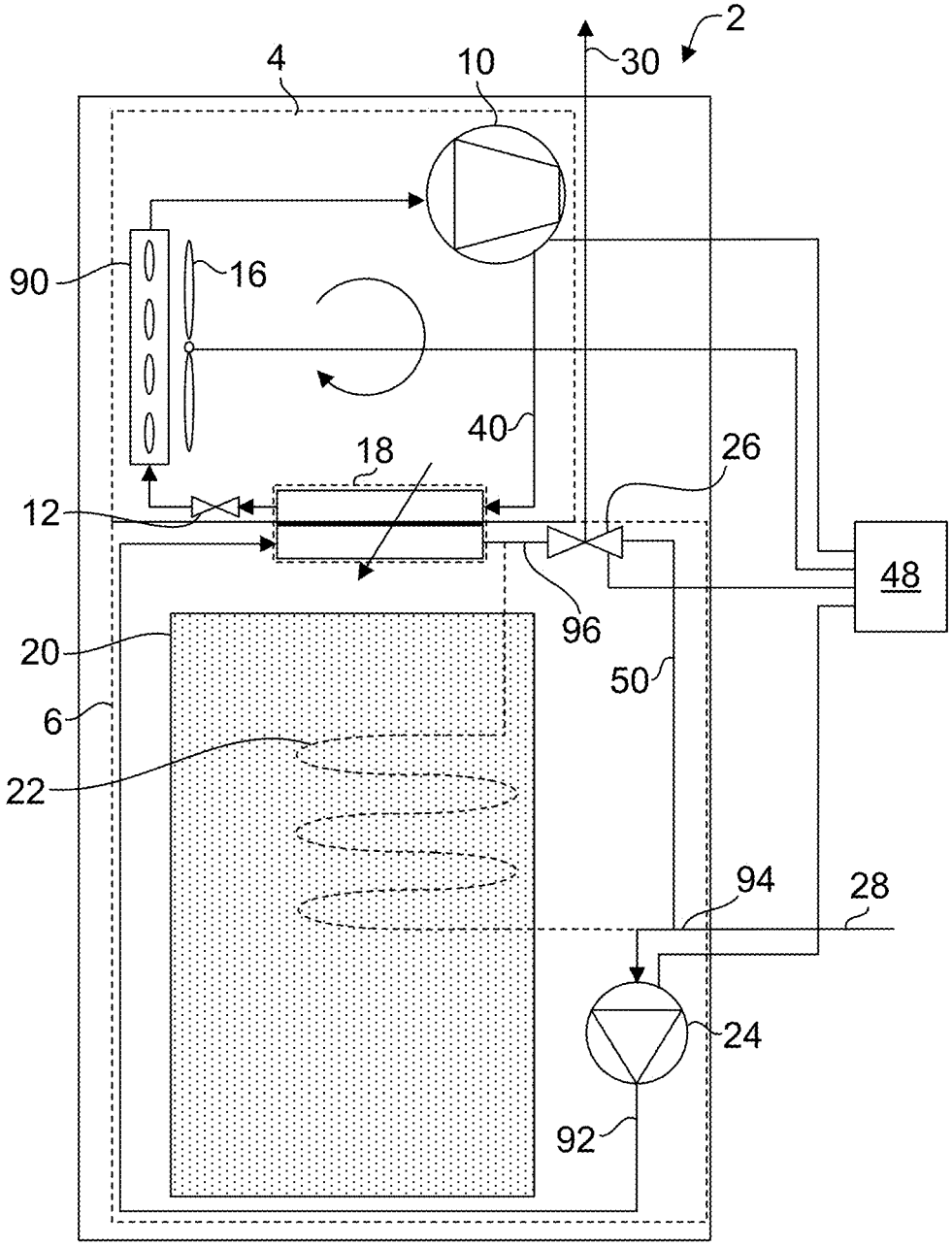
FIG. 3 is diagram depicting the present electric domestic water heating system of FIG. 2 being used to provide a hot water supply.

FIG. 3 is diagram depicting the present electric domestic water heating system of FIG. 2 being used to provide a hot water supply. As used herein, arrows are used to show the direction of travel of the first or second heat transfer fluid. The controller 48 is operable to control the first fluid moving device 10 to circulate the first heat transfer fluid in the first fluid conductor 40 and the second fluid moving device 24 to circulate the second heat transfer fluid in the second fluid conductor in response to a first hot water demand. The fluid moving device 10, e.g., compressor, compresses the refrigerant, increasing its temperature. At heat exchanger 18, the first heat transfer fluid condenses, giving off heat that is subsequently transferred from the first heat transfer fluid to the second heat transfer fluid. The second heat transfer fluid is domestic water circulated by the second fluid moving device 24, before exiting the hot water outlet 30. Upon exiting heat exchanger 18, the first heat transfer fluid enters an expansion valve 12 which reduces its pressure. Under a greatly reduced pressure, the first heat transfer fluid enters heat exchanger 90, e.g., evaporator, where heat is transferred from the environment of heat exchanger 90 to the first heat transfer fluid. As the blower 16 blows across the heat exchanger 90, the first heat transfer fluid absorbs heat and evaporates. The first fluid moving device 10 continues to compress the refrigerant, increasing its temperature and this cycle continues. Note that the portion 22 of the second fluid conductor is not active in this mode as pump 24 draws the second heat transfer fluid through it, starving a flow through the tank 20 while the mixing valve 26 blocks a flow through bypass fluid conductor 50.

Figure 4:
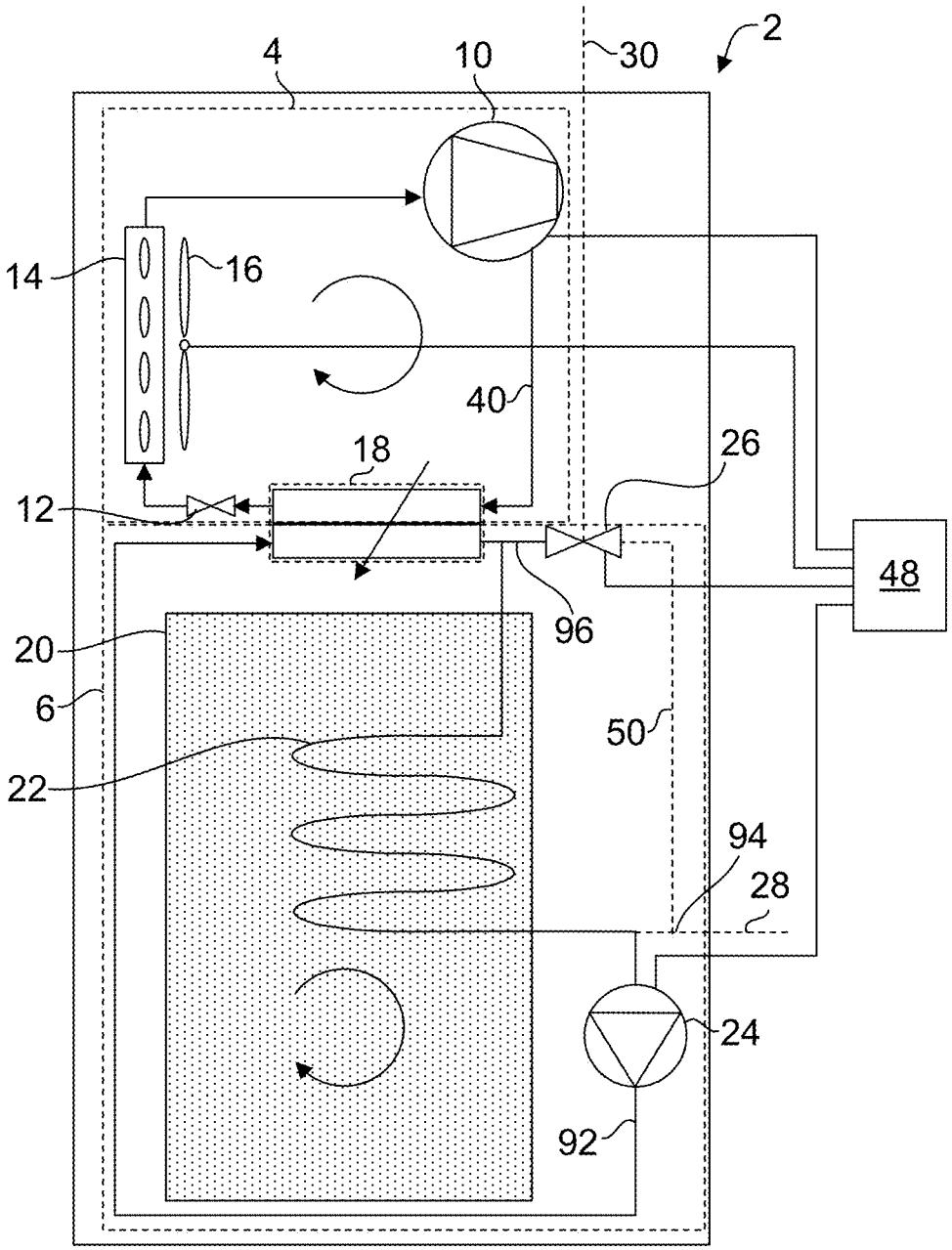
FIG. 4 is diagram depicting the present electric domestic water heating system of FIG. 2 being used to charge a thermal battery.

FIG. 4 is diagram depicting the present electric domestic water heating system of FIG. 2 being used to charge a thermal battery, i.e., the tank 20. Here, the controller is further operable to control the first fluid moving device 10 to circulate the first heat transfer fluid in the first fluid conductor 40 and the second fluid moving device 24 to circulate the second heat transfer fluid in the second fluid conductor 40 in response to a thermal charging demand of the bath of the tank 20.

Figure 5:
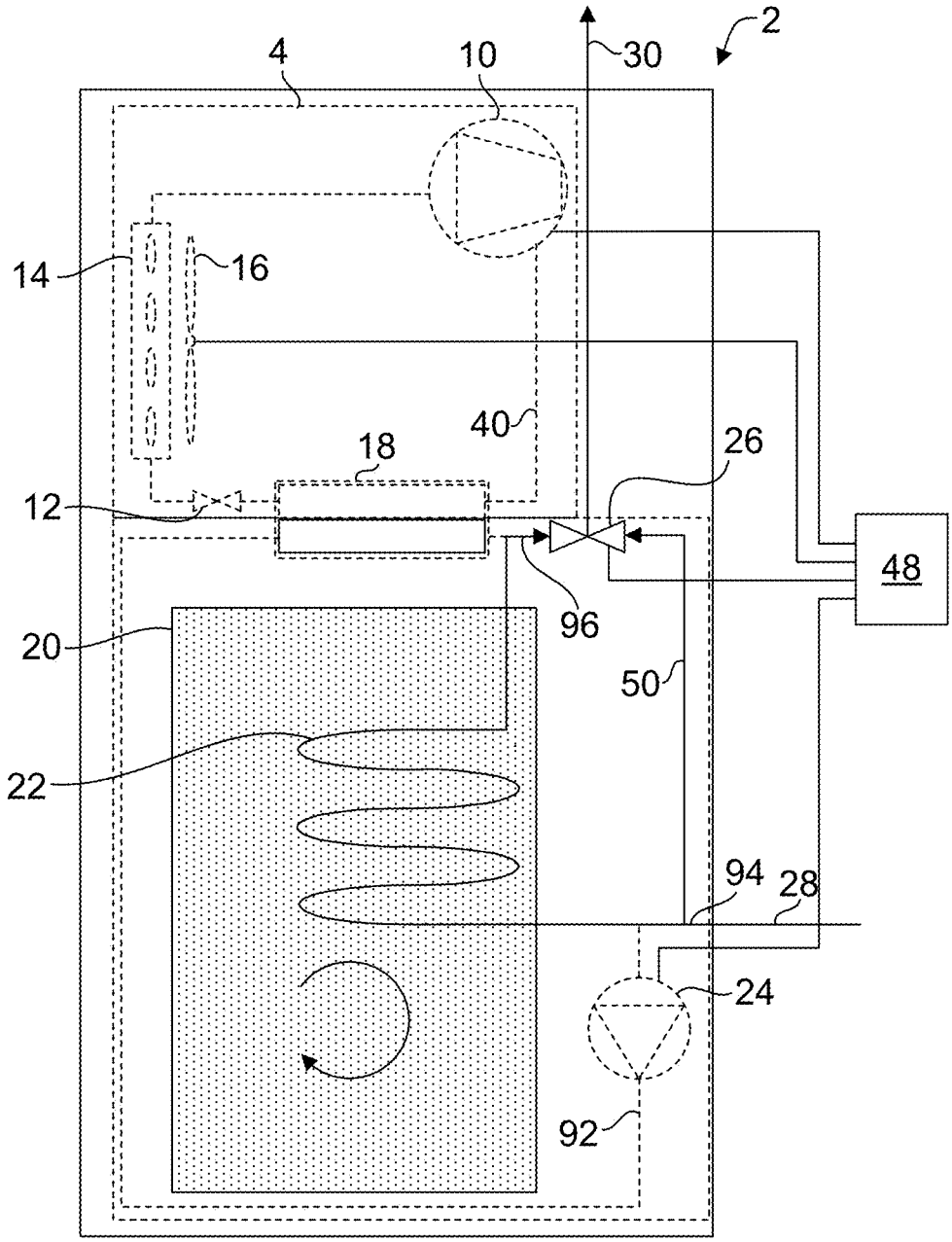
FIG. 5 is diagram depicting the present electric domestic water heating system of FIG. 2 being used to provide a hot water supply.

FIG. 5 is diagram depicting the present electric domestic water heating system of FIG. 2 being used to provide a hot water supply. Here, the controller is further operable to control the mixing valve 26 to allow mixing of the second heat transfer fluid through the portion 22 of the second fluid conductor and the bypass conductor in response to a second hot water demand. Note that FIGS. 2-5 each depicts primarily a domestic water heating system. The indoor/outdoor heat exchanger and its blower may be disposed either in an indoor or outdoor environment. If disposed in an indoor environment, they can additionally act as a space cooling system as it removes heat energy from the space and transfers the same to the domestic water. If disposed in an outdoor environment, heat energy is drawn from the outdoor environment to the domestic water.

Figure 6:
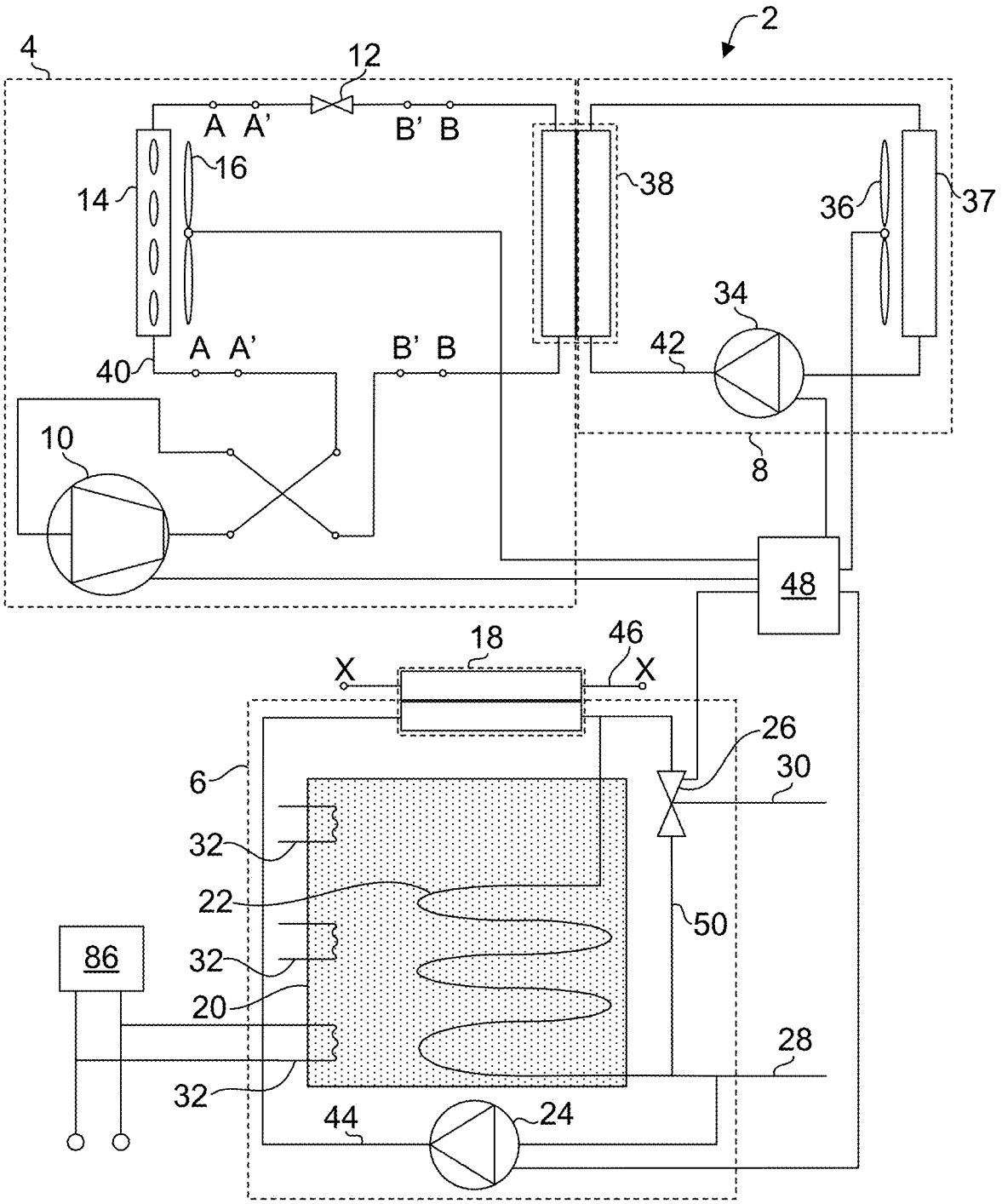
FIG. 6 is diagram depicting an electric domestic water heating, space heating and cooling system.

FIG. 6 is diagram depicting an electric domestic water heating, space heating and cooling system 2. The heating and cooling system 2 includes a first subsystem 4, 8 and a second subsystem 6. The first subsystem 4, 8 is configured for temperature conditioning of an indoor space, the first subsystem including a first heat exchanger 38, a heat pump and a second fluid moving device 34. In one embodiment, the second fluid moving device 34 is a pump. The heat pump includes a first fluid moving device 10 operable to circulate a first heat transfer fluid in a first fluid conductor 40, an outdoor heat exchanger 14, a first blower 16 operable to supply a stream of fluid over the outdoor heat exchanger 14, a pair of first hydraulic switches A-A' disposed about the outdoor heat exchanger 14. In one embodiment, the first heat transfer fluid is refrigerant, e.g., carbon dioxide.

The pair of first hydraulic switches are operable to disconnect the outdoor heat exchanger 14 from the first fluid conductor 40. A pair of second hydraulic switches B-B' are disposed about the first heat exchanger 38 where the pair of second hydraulic switches are operable to disconnect the first heat exchanger 38 from the first fluid conductor 40 and to connect the fourth fluid conductor (46) to the pair of second hydraulic switches. An outdoor heat exchanger can be any device, e.g., coil tube, configured to encourage heat energy exchanges between a fluid contained within the device with a fluid surrounding the device and typically disposed in an outdoor environment. The outdoor heat exchanger 14 and the first fluid moving device 10 are fluidly connected to the first fluid conductor 40 and the outdoor heat exchanger 14 is disposed to transfer heat between the first heat transfer fluid and the outdoor heat exchanger 14, whereby heat is transferred between the first heat transfer fluid and the stream of fluid over the outdoor heat exchanger 14. In one embodiment, the operation of the first blower 16 mirrors the operation of the first fluid moving device 10. In other words, when the first fluid moving device 10 is turned on, the first blower 16 is turned on as well. In one embodiment, the operation of the second blower 36 mirrors the operation of the second fluid moving device 34. In other words, when the second fluid moving device 34 is turned on, the second blower 36 is turned on as well.

The second fluid moving device 34 is operable to circulate a second heat transfer fluid in a second fluid conductor 42, an indoor heat exchanger and a second blower 36 operable to supply a stream of fluid over the indoor heat exchanger 37. In one embodiment, the second heat transfer fluid is water. The indoor heat exchanger 37 and the second fluid moving device 34 are fluidly connected to the second fluid conductor 42 and the indoor heat exchanger 37 is disposed to transfer heat between the second heat transfer fluid and the indoor heat exchanger 37, whereby heat is transferred between the second heat transfer fluid and the stream of fluid over the indoor heat exchanger 37. An indoor heat exchanger can be any device, e.g., coil tube, configured to encourage heat energy exchanges between a fluid contained within the device a fluid surrounding the device and typically disposed in an indoor environment. The second subsystem 6 is configured for heating a liquid, the second subsystem including a second heat exchanger 18, a tank 20 including a bath, a third fluid moving device 24 operable to circulate a third heat transfer fluid in a third fluid conductor 44, a mixing valve 26 and a fourth fluid conductor 46. The portion 22 of the third fluid conductor 44 disposed through the bath or immersed in the bath of the tank 20 is a heat exchanger, e.g., coiled tube heat exchanger, being disposed to transfer heat between the bath and the third heat transfer fluid. In one embodiment, the third heat transfer fluid is water. The second heat exchanger 18 and the third fluid moving device 24 are fluidly connected to the third fluid conductor and a portion of the third fluid conductor is disposed through the bath of the tank 20 and the third fluid conductor is not fluidly connected to the tank 20. Again, it shall be noted that the third fluid conductor is not fluidly connected to the tank and therefore the contents or bath of the tank 20 is isolated from the domestic water delivered to an end user via outlet 30, eliminating any ill effects of potential *Legionella* proliferation due to the tank 20. In one embodiment, the third fluid moving device 24 is a pump. In one embodiment, the bath includes water. In another embodiment, the bath includes a phase change material (PCM).

The mixing valve 26 includes two input ports and a discharge port, one of the two input ports, i.e., the first port, fluidly connected to a first end of the portion of the third fluid conductor via a bypass fluid conductor 50 and the other one of the two input ports, i.e., the second port, fluidly connected to a second end of the portion of the third fluid conductor and the discharge port connected to an outlet of the third fluid conductor. The fourth fluid conductor 46 includes two ends, i.e., the two ends terminated at X-X, wherein the second heat exchanger 18 being disposed to transfer heat between the third heat transfer fluid and a fluid within the fourth fluid conductor 46, i.e., the heat transfer fluid of the first fluid conductor once the fourth fluid conductor 46 has become active as X-X has been connected to the first fluid conductor 40. In the embodiment shown in FIG. 6, the heating and cooling system 2 further includes an electric battery 86 configured for storing electric power and powering the first fluid moving device 10, the first blower 16, the pair of first hydraulic switches, the pair of second hydraulic switches, the second fluid moving device 34, the second blower 36, the second fluid moving device 34, the third fluid moving device 24, the mixing valve 26 and the controller 48. Here, the electric battery 86 is shown to power at least one supplementary heating element 32 disposed within the bath of the tank 20 and operably connected to the electric battery 86. A supplementary heating element 32 can be power by grid electricity or alternatively or additionally be connected to another heating source, e.g., a solar electric or hydronic system, etc. A controller 48 is further provided and operably connected to the first fluid moving device 10, first blower 16, mixing valve 26, second fluid moving device 34, second blower 36 and third fluid moving device 24.

Figure 7:
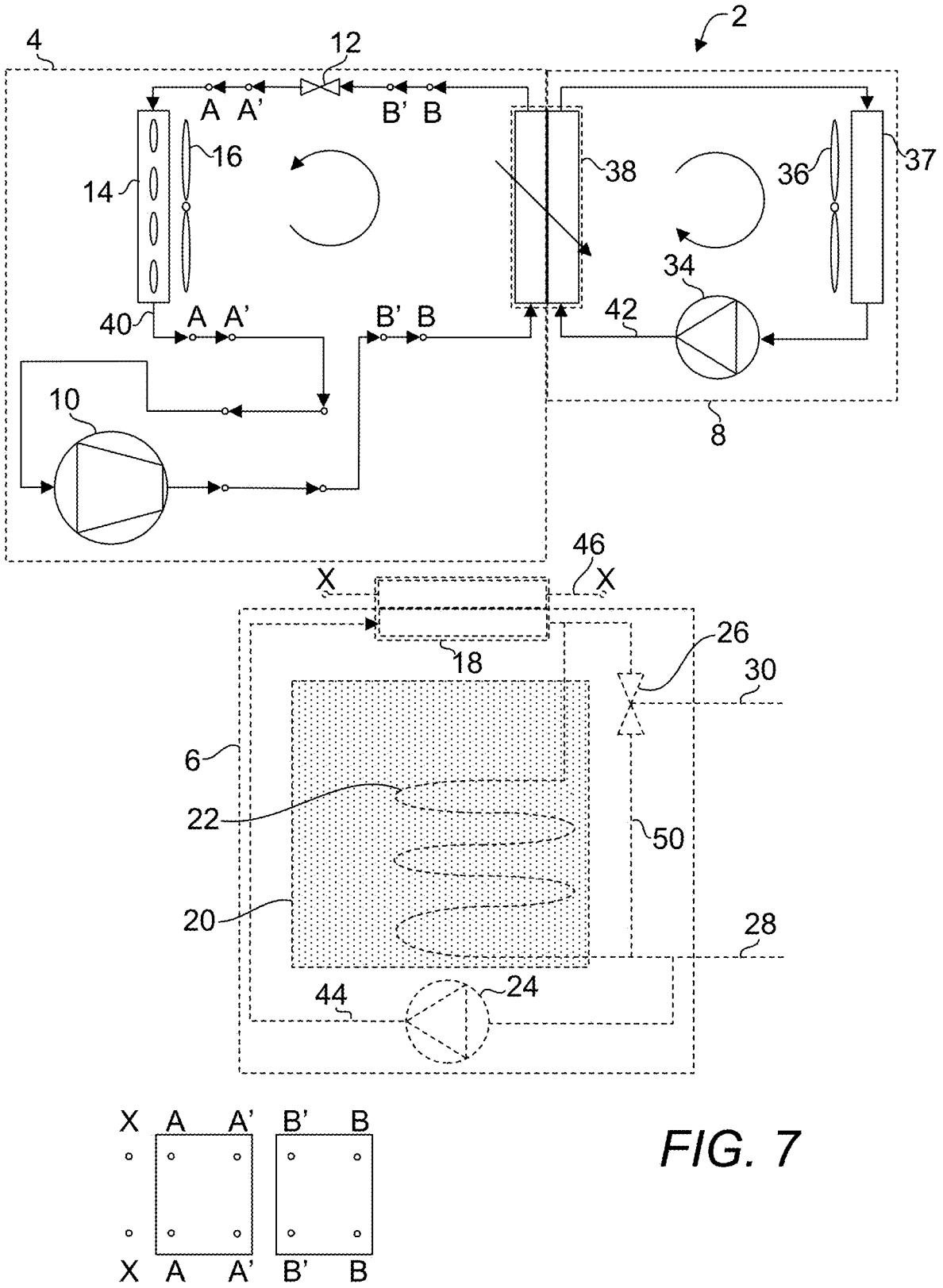
FIG. 7 is diagram depicting an electric domestic water heating, space heating and cooling system of FIG. 6 being used to provide space heating.

FIG. 7 is diagram depicting an electric domestic water heating, space heating and cooling system of FIG. 6 being used to provide space heating. It shall be noted that the flow direction of the first heat transfer fluid is now reversed as compared to the configuration shown in FIG. 6. In achieving this flow direction reversal, the heating and cooling system 2 further includes a hydraulic switch configured for reversing a direction of operation of the first fluid moving device 10. One example of the hydraulic switch is disposed in FIGS. 14 and 15. The controller is further operable to control the first fluid moving device to circulate the first heat transfer fluid in a second direction in the first fluid conductor 40, the second fluid moving device 34, the first blower 16 and the second blower 36 in response to a space heating demand. In each of FIGS. 7-11, the status of switches A-A' and B-B' are further indicated to facilitate the understanding of the different operating modes disclosed therein. Closed switches where contacts or fluid connections are made are shown in a common block. For instance, in FIG. 7, switch A-A is connected to switch A'-A' where fluid connection is possible between the segments of fluid conductors terminated with these switches and switch B'-B' is connected to switch B-B where fluid connection is possible between the segments of fluid conductors terminated with these switches. Switch X-X is not connected to another fluid circuit and therefore shown as an unconnected switch. Note that heat energy is received from the ambient environment of heat exchanger 14 and transferred to the ambient environment of heat exchanger 37.

Figure 8:
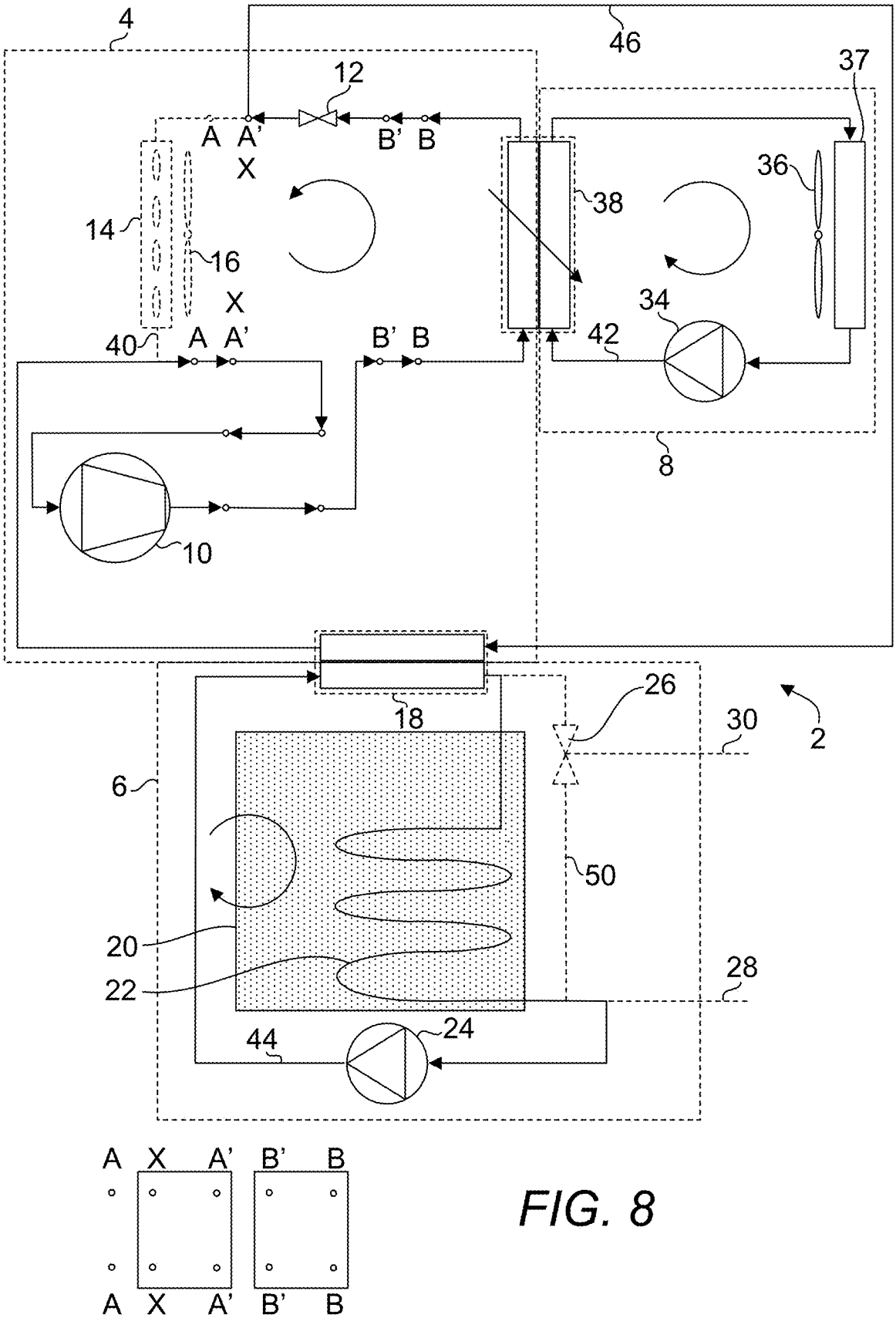
FIG. 8 is diagram depicting an electric domestic water heating, space heating and cooling system of FIG. 6 being used to provide space heating.

FIG. 8 is diagram depicting an electric domestic water heating, space heating and cooling system of FIG. 6 being used to provide space heating. The controller is further operable to cause the two ends X-X to be fluidly connected to the pair of first hydraulic switches, the pair of first hydraulic switches disposed in a position to disconnect the outdoor heat exchanger 14 from the first fluid conductor, the third fluid moving device to circulate the third heat transfer fluid and the first fluid moving device to circulate the first heat transfer fluid in the second direction, the first blower to turn on, the second fluid moving device to circulate the second heat transfer fluid and the second blower to turn on in response to a space heating demand. Note that heat energy is transferred from the tank 20 to the ambient environment of heat exchanger 37.

Figure 9:
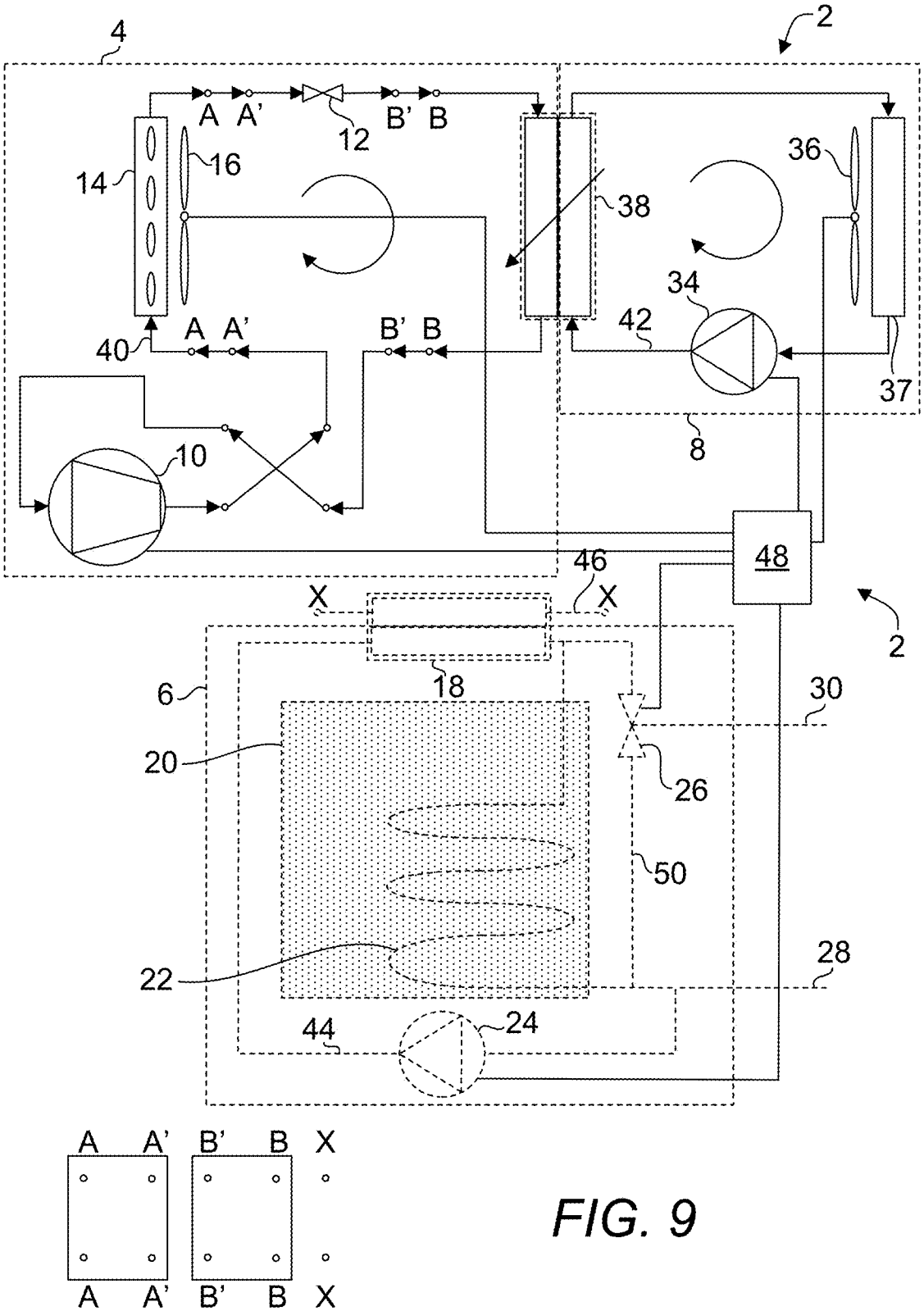
FIG. 9 is diagram depicting an electric domestic water heating, space heating and cooling system of FIG. 6 being used to provide space cooling.

FIG. 9 is diagram depicting an electric domestic water heating, space heating and cooling system of FIG. 6 being used to provide space cooling. The controller 48 is further operable to control the first fluid moving device to circulate the first heat transfer fluid in a first direction in the first fluid conductor 40, the first blower 16, the second blower 36 and the second fluid moving device 34 in response to a space cooling demand. Note that heat energy is removed from the ambient environment of heat exchanger 37 and transferred to the ambient environment of heat exchanger 14.

Figure 10:
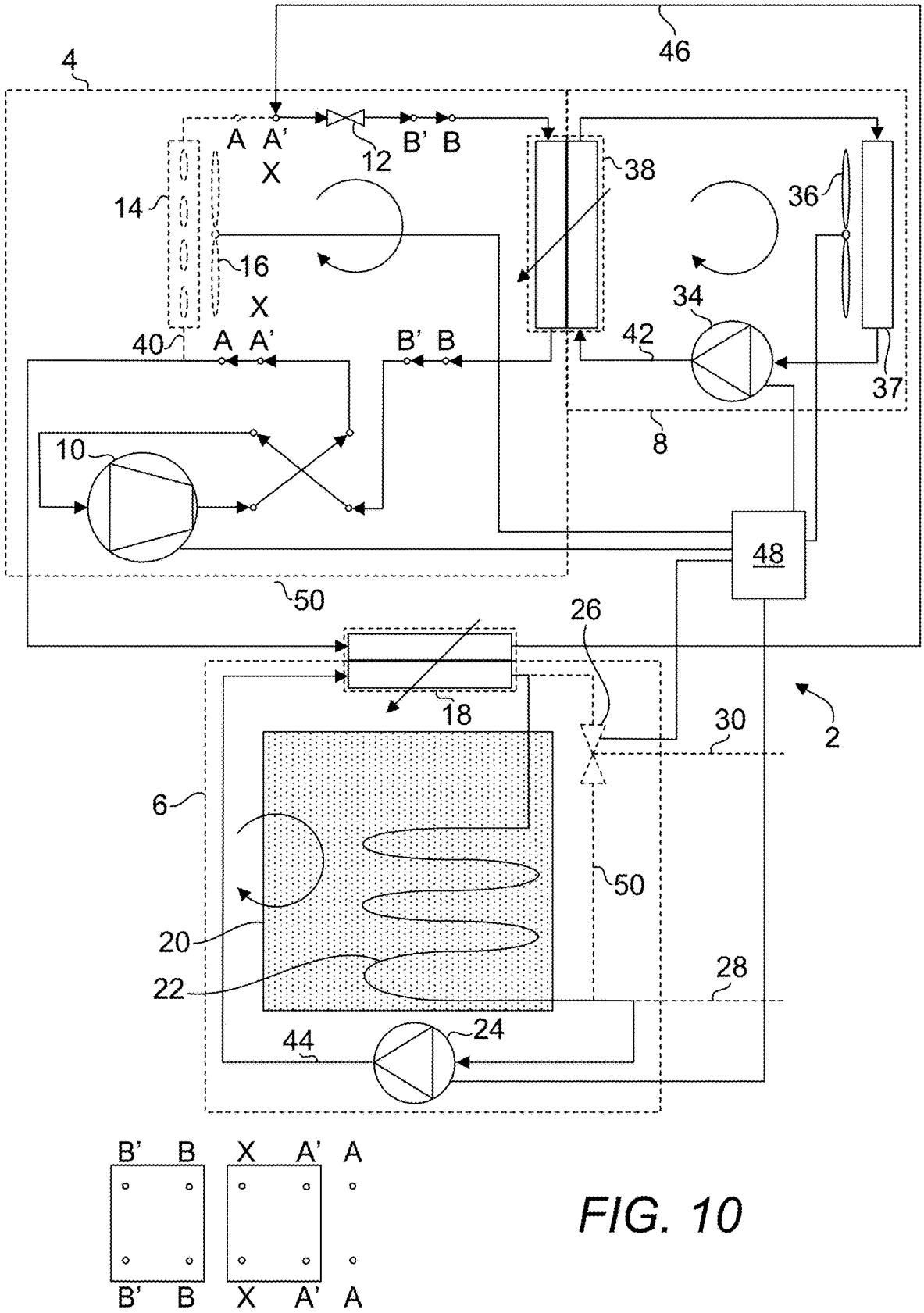
FIG. 10 is diagram depicting an electric domestic water heating, space heating and cooling system of FIG. 6 being used to provide space cooling.

FIG. 10 is diagram depicting an electric domestic water heating, space heating and cooling system of FIG. 6 being used to provide space cooling. The controller is further operable to cause the two ends to be fluidly connected to the pair of first hydraulic switches, the pair of first hydraulic switches disposed in a position to disconnect the outdoor heat exchanger 14 from the first fluid conductor, the third fluid moving device to circulate the third heat transfer fluid, the first fluid moving device to circulate the first heat transfer fluid in the first direction, the first blower 16 to turn on, the second fluid moving device to circulate the second heat transfer fluid and the second blower 36 to turn on in response to a space cooling demand. Note that heat energy is removed from the ambient environment of heat exchanger 37 and transferred to be stored in tank 20.

Figure 10A:
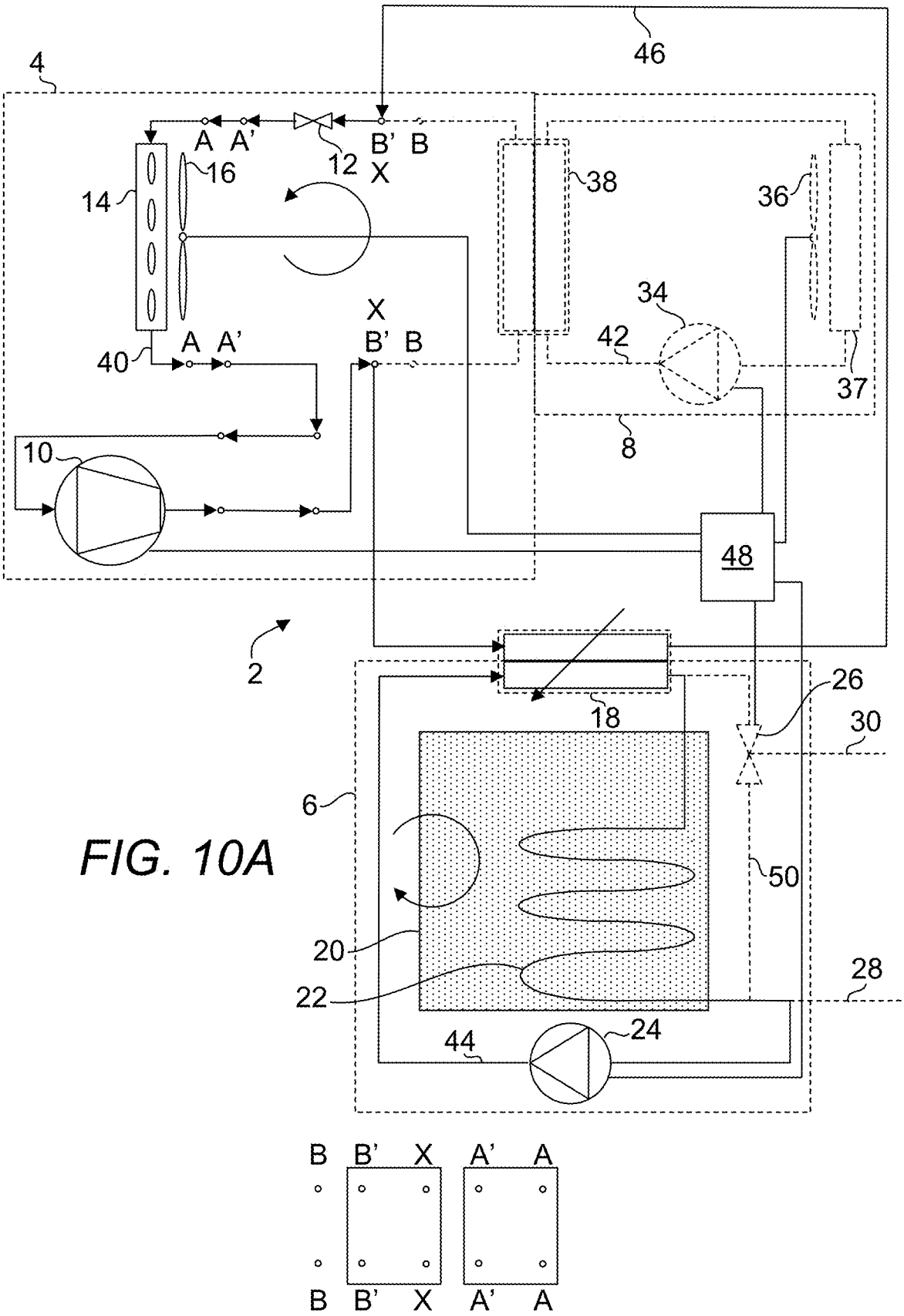
FIG. 10A is diagram depicting an electric domestic water heating, space heating and cooling system of FIG. 6 being used to store heat energy.

FIG. 10A is diagram depicting an electric domestic water heating, space heating and cooling system of FIG. 6 being used to store heat energy. In this mode, the first fluid moving device 10 is a compressor and the outdoor heat exchanger 14 serves an evaporator. The heat pump further includes an expansion valve 12 fluidly connected to the first fluid conductor. The controller is further operable to cause the two ends to be fluidly connected to the pair of second hydraulic switches, the pair of second hydraulic switches disposed in a position to disconnect the first heat exchanger 38 from the first fluid conductor, the third fluid moving device to circulate the third heat transfer fluid, the first fluid moving device to circulate the first heat transfer fluid in the second direction, the first blower 16 to turn on, the mixing valve to close the first port and the second port in response to a thermal charging demand of the bath of the tank 20. Note that heat energy is removed from the ambient environment of heat exchanger 14 and transferred to heat the bath of the tank 20.

Figure 11:
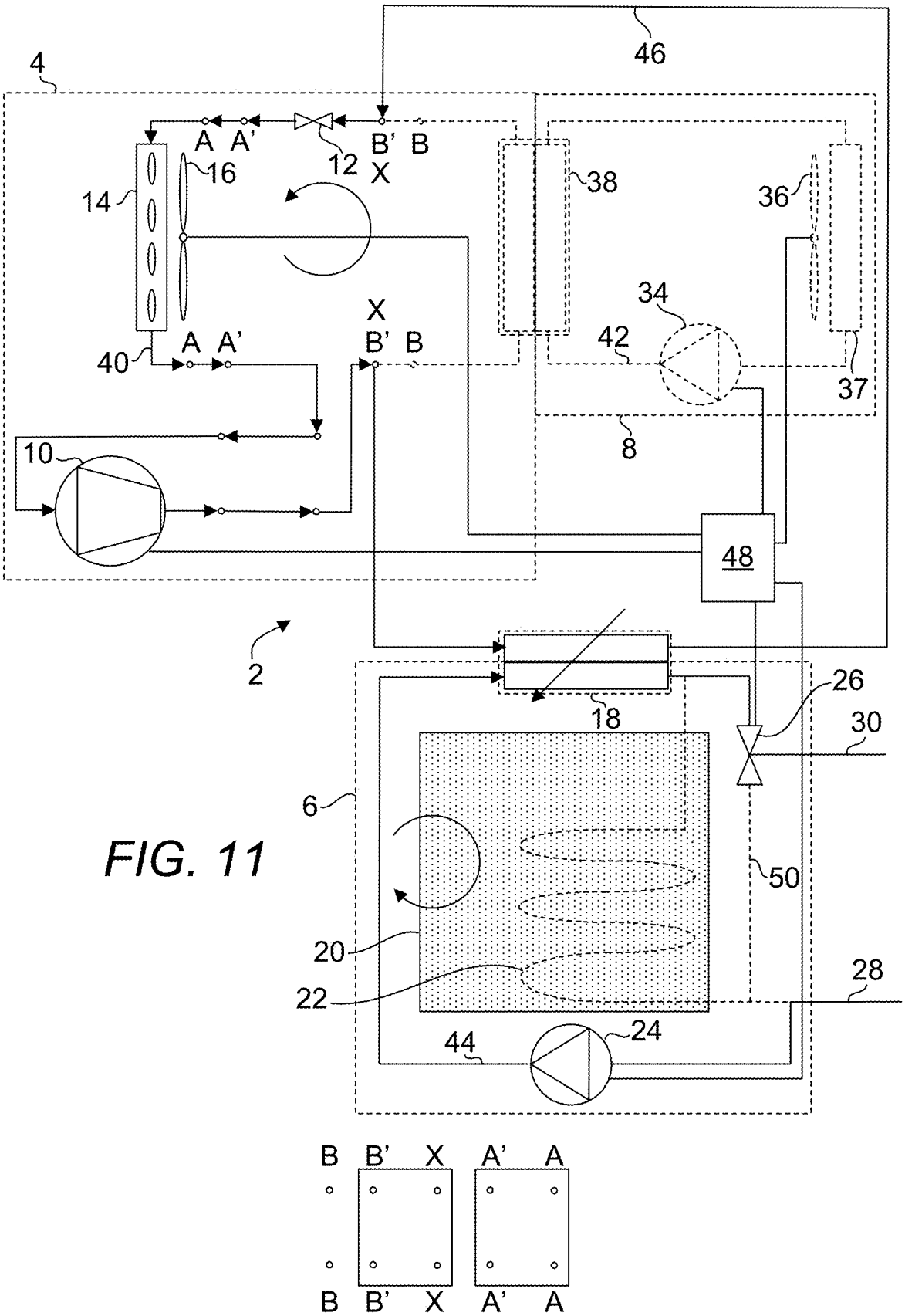
FIG. 11 is diagram depicting an electric domestic water heating, space heating and cooling system of FIG. 6 being used to provide a hot water supply.

FIG. 11 is diagram depicting an electric domestic water heating, space heating and cooling system of FIG. 6 being used to provide a hot water supply. In this mode, the first fluid moving device 10 is a compressor and the outdoor heat exchanger 14 serves an evaporator. The heat pump further includes an expansion valve 12 fluidly connected to the first fluid conductor. The controller is further operable to cause the two ends to be fluidly connected to the pair of second hydraulic switches, the pair of second hydraulic switches disposed in a position to disconnect the first heat exchanger 38 from the first fluid conductor, the third fluid moving device to circulate the third heat transfer fluid, the first fluid moving device to circulate the first heat transfer fluid in the second direction and the first blower 16 to turn on in response to a first hot water demand. Note that heat energy is removed from the ambient environment of heat exchanger 14 and transferred to heat a supply of domestic water.

Figure 12:
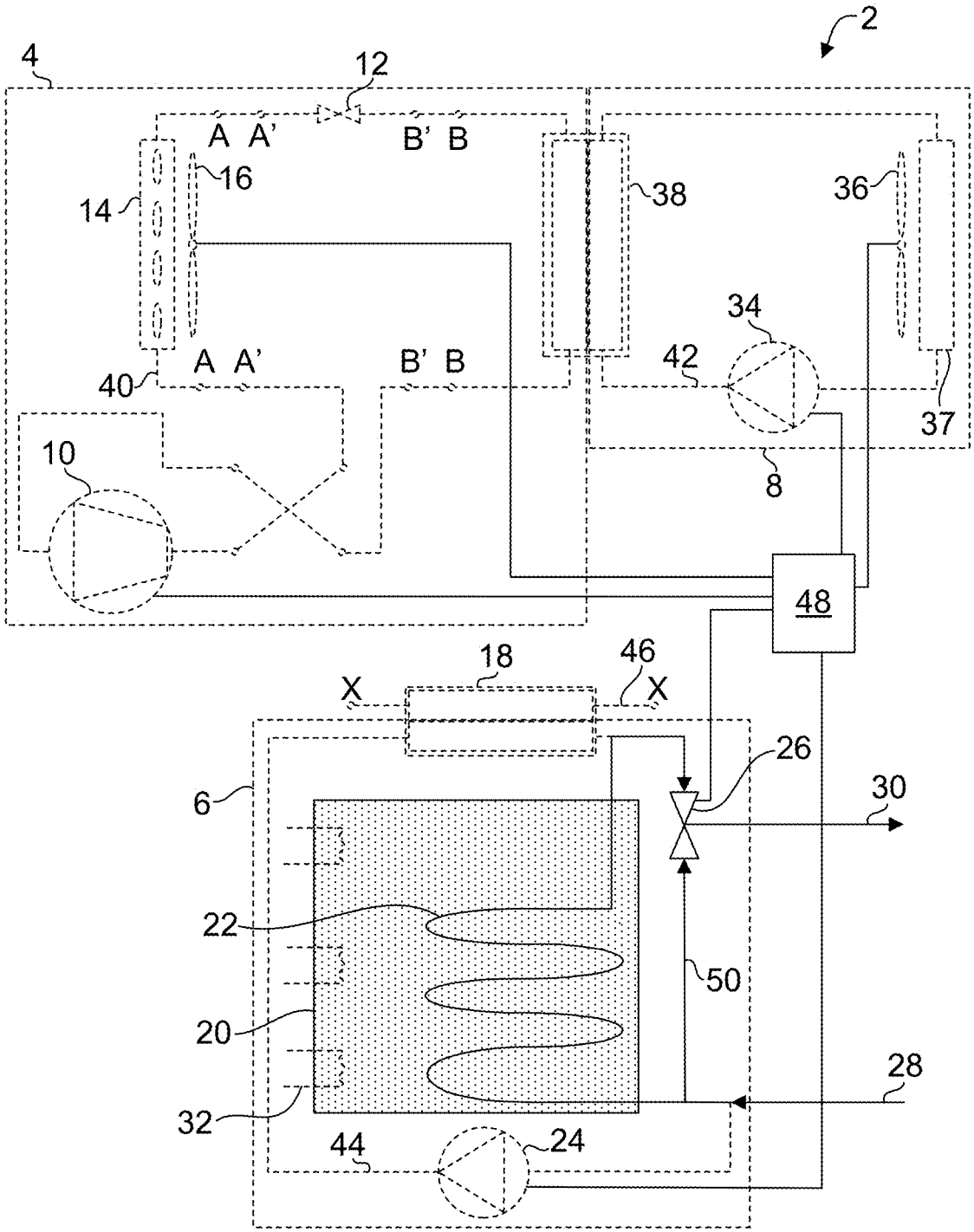
FIG. 12 is diagram depicting an electric domestic water heating, space heating and cooling system of FIG. 6 being used to provide a hot water supply.

FIG. 12 is diagram depicting an electric domestic water heating, space heating and cooling system 2 of FIG. 6 being used to provide a hot water supply. The controller is further operable to control the mixing valve 26 to allow mixing of the third heat transfer fluid through the portion 22 of the third fluid conductor and the bypass conductor 50 in response to a second hot water demand. Note that heat energy is drawn from the bath of the tank 20 and transferred to heat the third heat transfer fluid.

Figure 13:
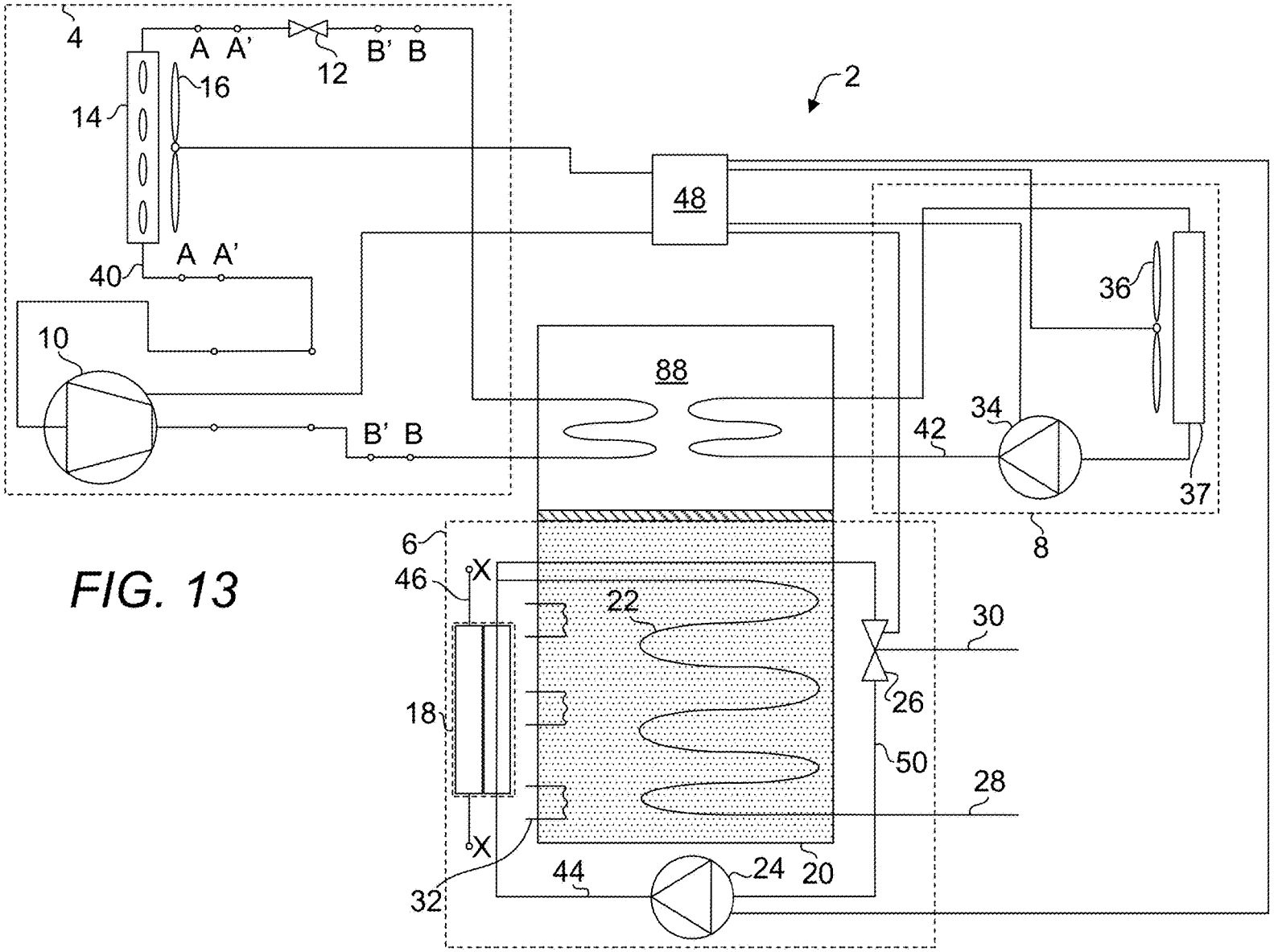
FIG. 13 is diagram depicting an electric domestic water heating, space heating and cooling system being used to provide a cold reservoir.
Figure 14:
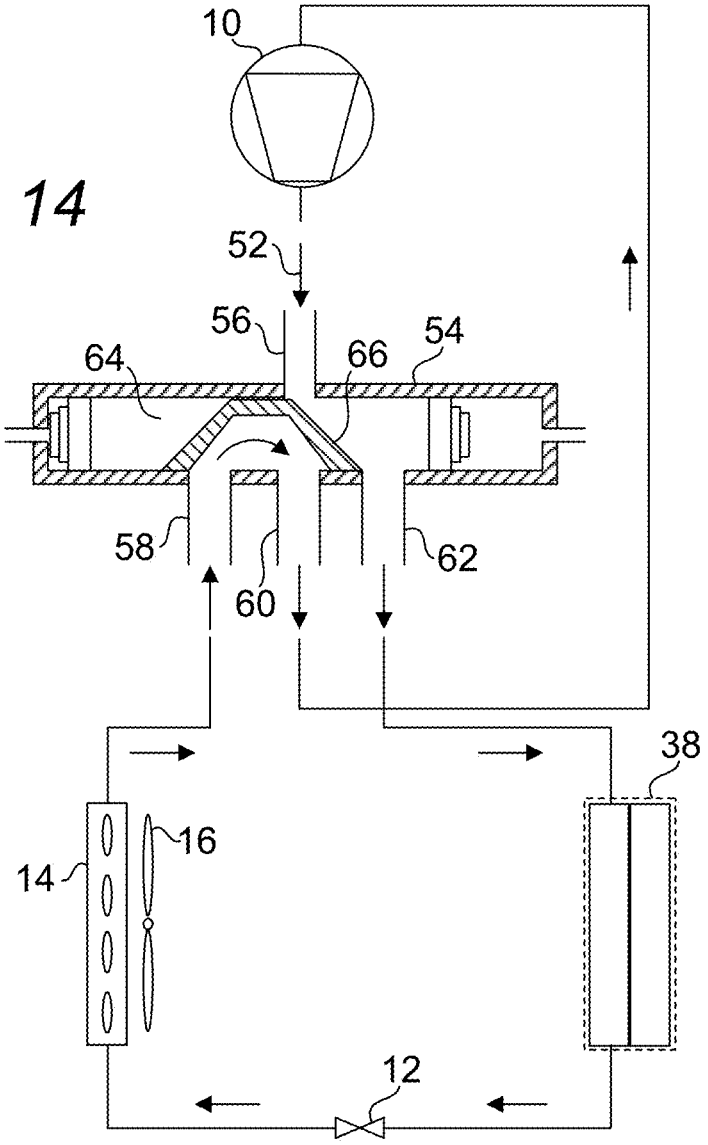
FIG. 14 is a diagram depicting one embodiment of a four-way two-position valve useful for reversing the flow of a flow loop where a valve spool is disposed in a first position.

FIG. 13 is diagram depicting an electric domestic water heating, space heating and cooling system 2 being used to provide a cold reservoir. In this embodiment, the first heat exchanger 38 includes a tank 88 including a bath, wherein the controller being further operable to control the first fluid moving device 10 to circulate the first heat transfer fluid in a first direction in the first fluid conductor 40 and the first blower 16 in response to a thermal discharging demand of the bath of the tank 88. The bath, e.g., water, of the tank 88 can therefore be disposed at a temperature lower than the ambient temperature of the outdoor heat exchanger 14. The controller being further operable to cause the two ends to be fluidly connected to the pair of first hydraulic switches, the pair of first hydraulic switches disposed in a position to disconnect the outdoor heat exchanger 14 from the first fluid conductor, the third fluid moving device to circulate the third heat transfer fluid and the first fluid moving device to circulate the first heat transfer fluid in the first direction in response to a thermal charging demand of the bath of the tank 20. Note that heat energy may be drawn from the bath of the tank 20 and transferred to the ambient environment of at least one of heat exchanger 14 and heat exchanger 37 by turning on the appropriate fluid moving device/s and blower/s. FIG. 14 is a diagram depicting one embodiment of a switch 54 useful for reversing the flow of a flow loop where a valve spool of the switch 54 is disposed in a first position. Switch 54 is applicable to any one of the fluid moving devices disclosed elsewhere herein. Here, the switch 54 is a four-way two-position valve having a valve body 64 on which ports 56, 58, 60, 62 are disposed. Port 56 is connected to the effluent of compressor 10 while port 58 is connected to one end of heat exchanger 14 and port 60 feeds into compressor 10. Spool 66 is configured to slide along valve body 64 and spool 66 is disposed in a position to fluidly connect port 58 to port 60 and port 56 to port 62. Port 62 is connected to one end of heat exchanger 38. While disposed this valve position, compressor 10 feeds into heat exchanger 38, making heat exchanger 38 a condenser. After passing expansion valve 12, the refrigerant flow through it expands. When the refrigerant flow passes through heat exchanger 38, the refrigerant evaporates, making heat exchanger 38 an evaporator.

Figure 15:
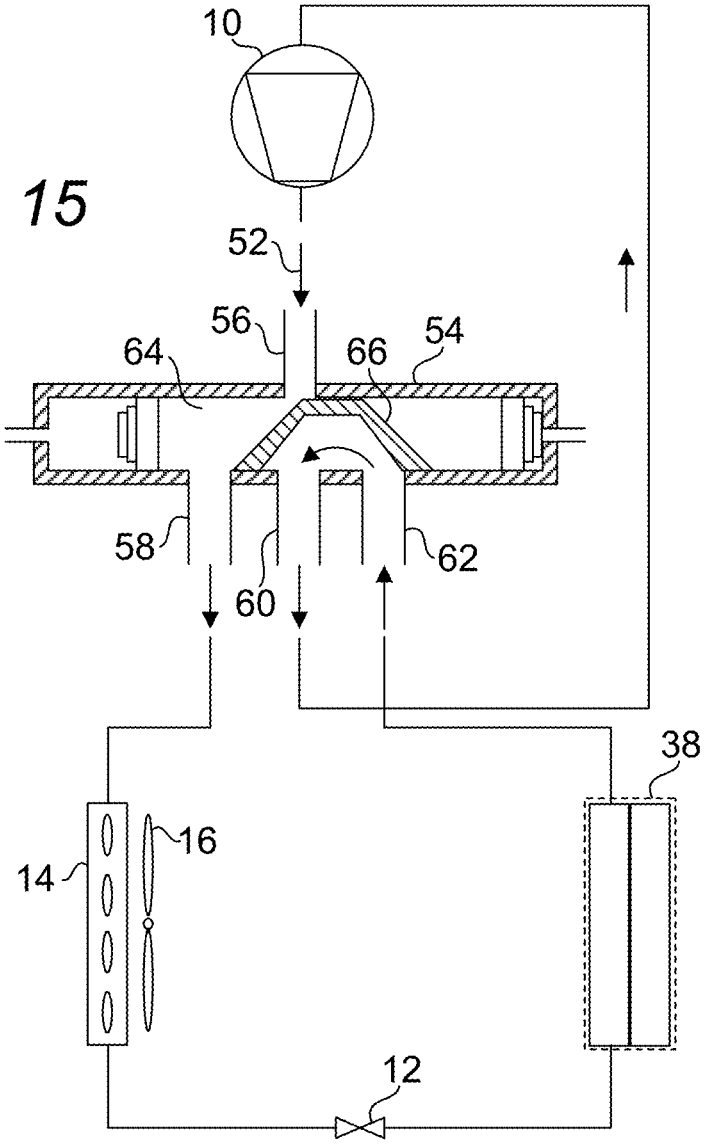
FIG. 15 is a diagram depicting one embodiment of a four-way two-position valve useful for reversing the flow of a flow loop where a valve spool is disposed in a second position.

FIG. 15 is a diagram depicting one embodiment of a switch 54 useful for reversing the flow of a flow loop where a valve spool is disposed in a second position. Switch 54 is applicable to any one of the fluid moving devices disclosed elsewhere herein. Here, the refrigerant flow 52 through each of heat exchanger 38 and expansion valve 12 has been reversed as contrasted to the condition shown in FIG. 14. Here, spool 66 is disposed in a position to fluidly connect port 58 to port 60 and port 56 to port 58. Port 62 is connected to port 60. While disposed in this valve position, compressor 10 feeds into heat exchanger 14, making heat exchanger 38 a condenser. After passing expansion valve 12, the refrigerant flow through it expands. When the refrigerant flow passes through heat exchanger 38, the refrigerant evaporates, making heat exchanger 38 an evaporator.

Figure 16:
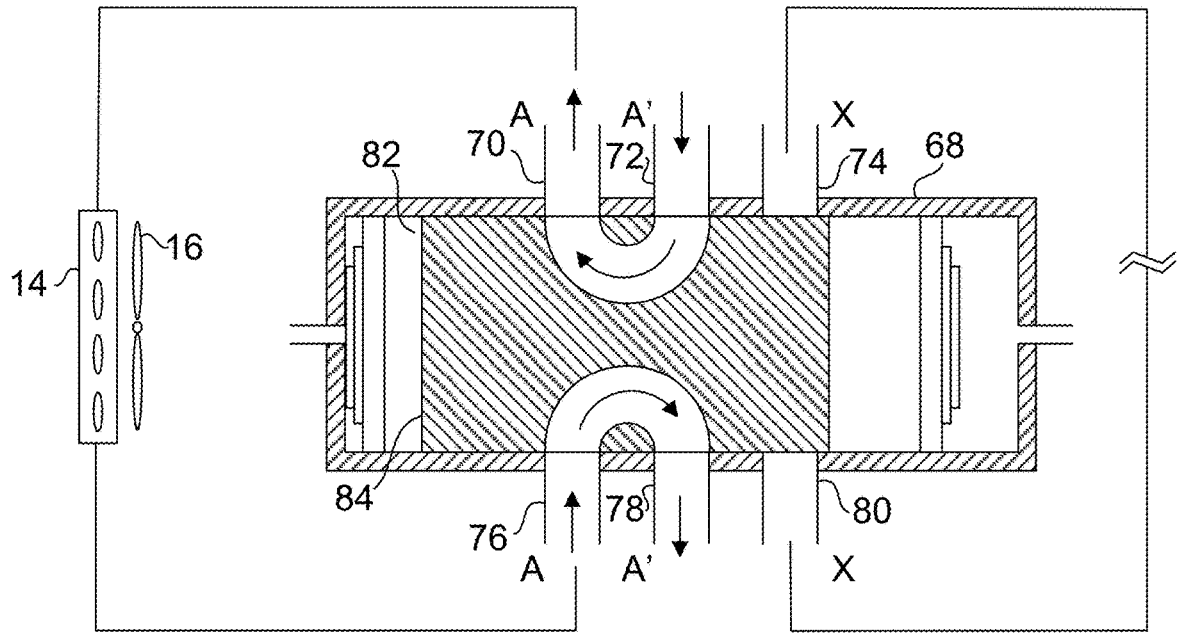
FIG. 16 is a diagram depicting one embodiment of 6-way two-position valve useful for switching a first flow loop for a second flow loop where a valve spool is disposed in a first position.

FIG. 16 is a diagram depicting one embodiment of a switch 68 useful for switching a first flow loop for a second flow loop where a valve spool is disposed in a first position. Switch 68 is applicable to any one of the flow circuits disclosed elsewhere herein. Here, the switch 68 is a 6-way two-position valve having a valve body 82 on which ports 70, 72, 74, 76, 78, 80 are disposed. Port 70 is connected to a first end of heat exchanger 14 while port 76 is connected to a second end of heat exchanger 14. The position of the spool 84 allows fluid communication between port 70 or A and port 72 or A' through a flow path disposed in the spool 84 and between port 76 or A and port 78 or A' through another flow path disposed in the spool 84, making the circuit connected to A-A active. Port 74 or X and port 80 or X are blocked and therefore the circuit connected to X-X is rendered inactive.

Figure 17:
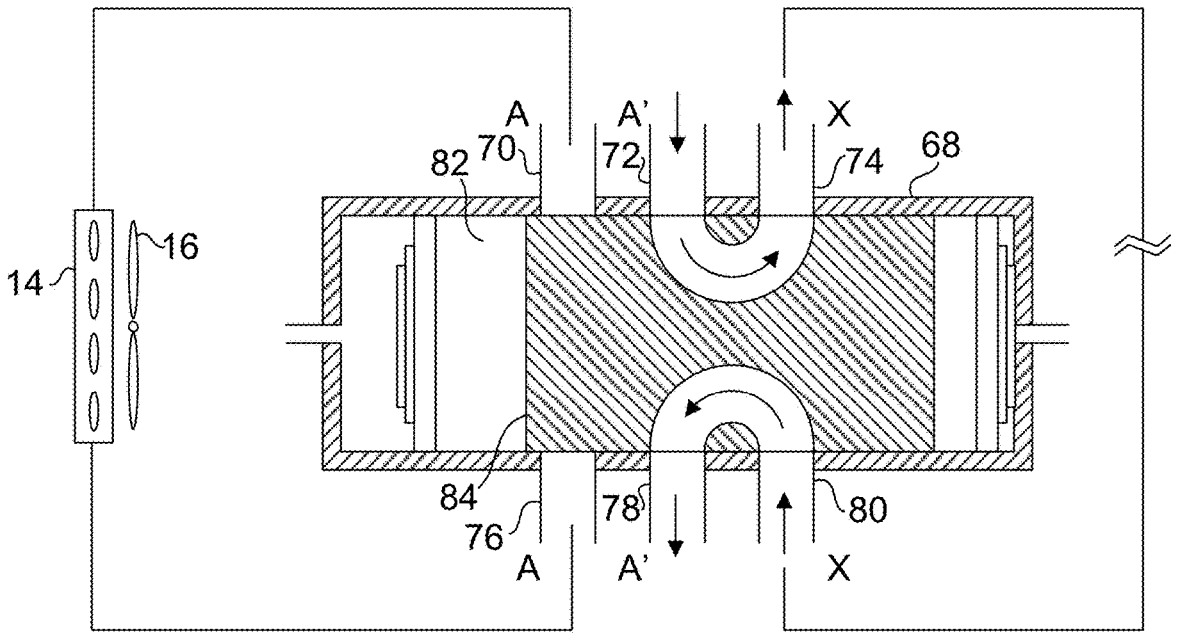
FIG. 17 is a diagram depicting one embodiment of 6-way two-position valve useful for switching a first flow loop for a second flow loop where a valve spool is disposed in a first position.

FIG. 17 is a diagram depicting one embodiment of 6-way two-position valve useful for switching a first flow loop for a second flow loop where a valve spool is disposed in a first position. Switch 68 is applicable to any one of the flow circuits disclosed elsewhere herein. Here, spool 84 is disposed in a position such that ports 70 or A and port 76 or A are now blocked and therefore the circuit connected to A-A is rendered inactive. Port 72 or A' and 74 or X are now fluidly connected through a flow path disposed in the spool 84 and port 78 or A' and 80 or X are now fluidly connected through a flow path disposed in the spool 84.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A heating and cooling system comprising:

(a) a first subsystem for temperature conditioning an indoor space, said first subsystem comprising:

(i) a first heat exchanger;

(ii) a heat pump comprising a first fluid moving device operable to circulate a first heat transfer fluid in a first fluid conductor, an outdoor heat exchanger, a first blower operable to supply a stream of fluid over said outdoor heat exchanger, a pair of first hydraulic switches disposed about said outdoor heat exchanger, said pair of first hydraulic switches operable to disconnect said outdoor heat exchanger from said first fluid conductor and a pair of second hydraulic switches disposed about said first heat exchanger, said pair of second hydraulic switches operable to disconnect said first heat exchanger from said first fluid conductor, wherein said outdoor heat exchanger and said first fluid moving device are fluidly connected to said first fluid conductor and said outdoor heat exchanger being disposed to transfer heat between said first heat transfer fluid and said outdoor heat exchanger, whereby heat is transferred between said first heat transfer fluid and said stream of fluid over said outdoor heat exchanger;

(iii) a second fluid moving device operable to circulate a second heat transfer fluid in a second fluid conductor, an indoor heat exchanger and a second blower operable to supply a stream of fluid over said indoor heat exchanger, wherein said indoor heat exchanger and said second fluid moving device are fluidly connected to said second fluid conductor and said indoor heat exchanger being disposed to transfer heat between said second heat transfer fluid and said indoor heat exchanger, whereby heat is transferred between said second heat transfer fluid and said stream of fluid over said indoor heat exchanger; and (b) a second subsystem for heating liquid, said second subsystem comprising:

(i) a second heat exchanger;

(ii) a tank comprising a bath;

(iii) a third fluid moving device operable to circulate a third heat transfer fluid in a third fluid conductor, wherein said second heat exchanger and said third fluid moving device are fluidly connected to said third fluid conductor and a portion of said third fluid conductor is disposed through said bath of said tank and said third fluid conductor is not fluidly connected to said tank;

(iv) a mixing valve comprising two input ports and a discharge port, one of said two input ports fluidly connected to a first end of said portion of said third fluid conductor via a bypass fluid conductor and the other one of said two input ports fluidly connected to a second end of said portion of said third fluid conductor and said discharge port connected to an outlet of said third fluid conductor; and (v) a fourth fluid conductor comprising two ends, wherein said first heat exchanger being disposed to transfer heat between said third heat transfer fluid and said a fluid within said fourth fluid conductor; and (c) a controller operable to control said first fluid moving device to circulate said first heat transfer fluid, to control said pair of first hydraulic switches to be disposed in a position to cause said first heat transfer fluid to be directed in a first direction in said first fluid conductor, to control said first blower, to control said second fluid moving device to circulate said second heat transfer fluid in said second fluid conductor and to control said second blower, in response to a space cooling demand, said controller being further operable to control said first fluid moving device to circulate said first heat transfer fluid, to control said pair of first hydraulic switches to be disposed in a position to cause said first heat transfer fluid to be directed in a second direction in said first fluid conductor, to control said first blower, to control said second blower and to control said second fluid moving device, in response to a space heating demand, said controller being further operable to cause said two ends to be fluidly connected to said pair of second hydraulic switches, to cause said pair of second hydraulic switches to be disposed in a position to disconnect said first heat exchanger from said first fluid conductor and to connect said fourth fluid conductor to said pair of second hydraulic switches, to cause said third fluid moving device to circulate said third heat transfer fluid, to cause said first fluid moving device to circulate said first heat transfer fluid, to cause said pair of first hydraulic switches to be disposed in a position to cause said first heat transfer fluid to be directed in said second direction in said first fluid conductor and to cause said first blower to turn on, in response to a first hot water demand, said controller being further operable to control said mixing valve to allow mixing of said third heat transfer fluid through said portion of said third fluid conductor and said bypass conductor, in response to a second hot water demand, said controller being further operable to cause said two ends to be fluidly connected to said pair of first hydraulic switches, to cause said pair of first hydraulic switches to be disposed in a position to disconnect said outdoor heat exchanger from said first fluid conductor and to connect said fourth fluid conductor to said pair of first hydraulic switches, to cause said third fluid moving device to circulate said third heat transfer fluid, to cause said first fluid moving device to circulate said first heat transfer fluid, to cause said pair of first hydraulic switches to be disposed in a position to cause said first heat transfer fluid to be directed in said second direction in said first fluid conductor, to cause said first blower to turn on and said second blower to turn on, in response to a space heating demand, said controller being further operable to cause said two ends to be fluidly connected to said pair of first hydraulic switches, to cause said pair of first hydraulic switches to be disposed in a position to disconnect said outdoor heat exchanger from said first fluid conductor, to cause said third fluid moving device to circulate said third heat transfer fluid, to cause said first fluid moving device to circulate said first heat transfer fluid, to cause said pair of first hydraulic switches to be disposed in a position to cause said first heat transfer fluid to be directed in said first direction and to cause said second fluid moving device to circulate said second heat transfer fluid, in response to a space cooling demand, and said controller being further operable to cause said two ends to be fluidly connected to said pair of first hydraulic switches, to cause said pair of first hydraulic switches to be disposed in a position to disconnect said outdoor heat exchanger from said first fluid conductor and to connect said fourth fluid conductor to said pair of first hydraulic switches, to cause said third fluid moving device to circulate said third heat transfer fluid, to cause said first fluid moving device to circulate the first heat transfer fluid, to cause said pair of first hydraulic switches to be disposed in a position to cause said first heat transfer fluid to be directed in the first direction and to control said first blower, in response to a thermal charging demand of said bath of said tank.

2. The heating and cooling system of claim 1, said portion of said third fluid conductor disposed through said bath of said tank is a heat exchanger being disposed to transfer heat between said bath and said third heat transfer fluid.

3. The heating and cooling system of claim 1, wherein said first fluid moving device is a compressor, wherein said heat pump further comprises an expansion valve fluidly connected to said first fluid conductor.

4. The heating and cooling system of claim 1, wherein said bath comprises a material selected from the group consisting of water and another phase change material (PCM).

5. The heating and cooling system of claim 1, further comprising at least one supplementary heating element configured to be disposed within said bath of said tank.

6. The heating and cooling system of claim 1, wherein said first heat transfer fluid is a refrigerant.

7. The heating and cooling system of claim 1, wherein said second heat transfer fluid is water.

8. The heating and cooling system of claim 1, wherein said third heat transfer fluid is water.

9. The heating and cooling system of claim 1, further comprising an electric battery configured for storing electric power and powering at least one of said first fluid moving device, said first blower, said pair of first hydraulic switches, said pair of second hydraulic switches, said second fluid moving device, said second blower, said second fluid moving device, said third fluid moving device, said mixing valve and said control device.

10. The heating and cooling system of claim 1, wherein said first heat exchanger is a tank comprising a bath, wherein said controller being further operable to control said first fluid moving device to circulate said first heat transfer fluid, to control said pair of first hydraulic switches to be disposed in a position to cause said first heat transfer fluid to be directed in a first direction in said first fluid conductor and to control said first blower, in response to a thermal discharging demand of said bath of said tank.

* * * * *